United States Patent [19]

Tsubakimoto et al.

[11] Patent Number: 4,872,885

[45] Date of Patent: Oct. 10, 1989

[54] DISPERSANT FOR AQUEOUS SLURRY OF CARBONACEOUS SOLID AND AQUEOUS CARBONACEOUS SOLID SLURRY COMPOSITION INCORPORATING SAID DISPERSANT THEREIN

[75] Inventors: Tsuneo Tsubakimoto, Toyonaka; Hayami Ito, Himeji; Shuhei Tatsumi, Akashi; Yoshihiro Kajibata, Hyogo; Shoichi Takao, Akashi; Takakiyo Goto, Yokohama; Akio Nakaishi, Yokosuka; Kenji Rakutani, Yokohama; Toshio Tamura, Yokohama; Hiroya Kobayashi, Minoo, all of Japan

[73] Assignees: Kawasaki Jukogyo Kagushiki Kaisha, Hyogo: Nippon Shokubai Kagaku Kogyo Co., Ltd., Osaka, both of Japan

[21] Appl. No.: 171,866

[22] PCT Filed: Feb. 20, 1987

[86] PCT No.: PCT/JP87/00109

§ 371 Date: Feb. 23, 1988

§ 102(e) Date: Feb. 23, 1988

[30] Foreign Application Priority Data

| | | | |
|---|---|---|---|
| Feb. 27, 1986 | [JP] | Japan | 61-150939 |
| Aug. 19, 1986 | [JP] | Japan | 61-192055 |
| Aug. 27, 1986 | [JP] | Japan | 61-199069 |
| Aug. 27, 1986 | [JP] | Japan | 61-199070 |
| Dec. 19, 1986 | [JP] | Japan | 61-305031 |
| Dec. 19, 1986 | [JP] | Japan | 61-305032 |
| Dec. 19, 1986 | [JP] | Japan | 61-305033 |
| Dec. 19, 1986 | [JP] | Japan | 61-305034 |

[51] Int. Cl.[4] ..... C10L 1/32

[52] U.S. Cl. ..... 44/51; 44/62; 44/70; 252/312; 252/356; 524/599

[58] Field of Search ..... 44/51, 62, 70; 252/312, 252/356; 529/69, 765; 5/767, 599

[56] References Cited

U.S. PATENT DOCUMENTS

| | | | |
|---|---|---|---|
| 4,217,109 | 8/1980 | Siwersson et al. | 44/51 |
| 4,242,098 | 12/1980 | Brown et al. | 44/51 |
| 4,358,293 | 9/1982 | Mark | 44/51 |
| 4,375,358 | 3/1983 | Swartz et al. | 44/51 |
| 4,536,187 | 8/1985 | Hansen et al. | 44/51 |
| 4,564,371 | 1/1986 | Ueda | 44/51 |
| 4,623,359 | 11/1986 | Yaghmaie et al. | 44/51 |
| 4,652,271 | 3/1987 | Rybinski et al. | 44/51 |
| 4,740,329 | 4/1988 | Wrench | 44/51 |
| 4,744,795 | 5/1988 | Savoly et al. | 44/51 |

FOREIGN PATENT DOCUMENTS

| | | |
|---|---|---|
| 59-0025889 | 2/1984 | Japan . |
| 59-0068393 | 4/1984 | Japan . |
| 59-0125351 | 6/1984 | Japan . |
| 59-0221387 | 12/1984 | Japan . |
| 59-0221388 | 12/1984 | Japan . |

*Primary Examiner*—William R. Dixon, Jr.
*Assistant Examiner*—Margaret B. Medley
*Attorney, Agent, or Firm*—Omri M. Behr

[57] ABSTRACT

This invention discloses (1) a dispersant for an aqueous carbonaceous solid slurry, which comprises a water-soluble copolymer having an average molecular weight of 1,000 to 500,000 and obtained by polymerizing (A) 0.1 to 7 mol % of a polyalkylene glycol mono(meth)acrylate type monomer, (B) 5 to 94.9 mol % of a sulfoalkyl (meth)acrylate type monomer, (C) 5 to 94.9 mol % of an unsaturated carboxylic acid type monomer, and (D) 0 to 20 mol % of other monomer (providing that the total amount of the monomers is 100 mol %) and/or a salt of the water-soluble copolymer and (2) an aqueous carbonaceous solid slurry composition, which comprises 100 parts by weight of as carbonaceous solid and 0.01 to 5 parts by weight of the aforementioned dispersant.

26 Claims, 1 Drawing Sheet

DISPERSANT FOR AQUEOUS SLURRY OF CARBONACEOUS SOLID AND AQUEOUS CARBONACEOUS SOLID SLURRY COMPOSITION INCORPORATING SAID DISPERSANT THEREIN

TECHNICAL FIELD

This invention relates to a dispersant for the aqueous slurry of a carbonaceous solid and to an aqueous carbonaceous solid slurry composition obtained by the incorporation of the dispersant. More particularly, it relates to a dispersant for effecting dispersion of a carbonaceous solid in water thereby producing an aqueous carbonaceous solid slurry composition possessing flowability even in high concentration.

BACKGROUND ART

The petroleum which has been heretofore in extensive use as an energy source is now suffering a notable rise of price and threatening exhaustion of deposit. In the circumstance, the development of some other energy source capable of stable supply has constituted itself a task to be imposed on the industry. Studies are now under way for the development of techniques for effective use of such carbonaceous solids as coal, oil coke, and petroleum pitch. As actual means for effective use of such carbonaceous solids, thermal decomposition, gasification, combustion, substitution for heavy oil blown into blast furnaces in the steel-making industry, and substitution for heavy oil used in kilns in the cement industry, for example, are conceivable. In these techniques for effective use of carbonaceous solids, since the carbonaceous solids are in a solid state at normal room temperature, they are handled only with difficulty. These carbonaceous solids are not easily used effectively as desired because they have the disadvantage that the fine particles crumbling from these solids are drifted in wind to pollute the environment and threaten dust explosion. The desirability of converting these carbonaceous solids into liquids thereby ensuring ease of handling and precluding environmental pollution and dust explosion is finding growing recognition. Further for the purpose of lowering the cost of transportation, it is desirable to convert these carbonaceous solids into liquids.

For the purpose mentioned above, the conversion of a carbonaceous solid into a slurry proves to be a desirable way of ensuring effective use of the carbonaceous solid. For this slurry to be utilized for thermal decomposition, gasification, combustion, substitution for heavy oil to be blown into blast furnaces, and substitution for heavy oil to be used in kilns for cement production, it must be prepared in a highly concentrated form and, at the same time, must be prevented from inducing the phenomenon of solid-liquid separation due to sedimentation of solid particles suspended in the slurry.

In recent years, as means for converting a carbonaceous solid into a slurry, the method which effects this conversion by causing the carbonaceous solid to be dispersed in a medium such as water, methanol, or a fuel oil, for example has been proposed. To cite a typical example, the COM (coal-oil mixture) which can be transported through a pipeline is verging on practical use. Since the COM uses a fuel oil, it still has room for some anxiety about stability of supply and price. To avoid the difficulty, a highly concentrated aqueous slurry of a carbonaceous solid using water as an inexpensive and readily available medium is attracting keen attention as a highly promising approach to the effective use of carbonaceous solids.

An attempt at increasing the concentration of a carbonaceous solid in the aqueous carbonaceous solid slurry by the known method, however, results in a notable addition to the viscosity and loss of the flowability of the slurry. Conversely, a decrease of the concentration of the carbonaceous solid in the slurry results in a decline as in the efficiency of transportation and the efficiency of combustion. Further when the aqueous carbonaceous solid slurry of a lowered solid concentration is put to use in applications which require removal of excess water, the treatments for the removal of water from the slurry and the desiccation of the remaining cake call for an unduly large expense and entail the problem of environmental pollution.

Heretofore, for the solution of the various problems mentioned above, various dispersants for aqueous carbonaceous solid slurries have been proposed. Typical examples of such dispersants include such surfactants and water-soluble polymers as sodium oleate (U.S. Pat. No. 2,128,913), polyoxyethylene alkylphenyl ether (U.S. Pat. No. 4,094,810), stearylamine hydrochloride (U.S. Pat. No. 2,899,392), polyethylene oxide (U.S. Pat. No. 4,242,098), cellulose (U.S. Pat. No. 4,242,098), polysodium acrylate (U.S. Pat. No. 4,217,109), sodium lignosulfonate (U.S. Pat. No. 4,104,035), formalin condensate of alkylphenol alkylene oxide adduct (Japanese Patent Laid-Open SHO No. 59(1984)-36,537), and formalin condensate of sodium naphthalenesulfonate (Japanese Patent Laid-Open SHO No. 56(1981)-21,636). These dispersants, however, are invariably deficient in practicability because the aqueous carbonaceous solid slurries produced by incorporation thereof have no sufficient flowability and because such slurries necessitate incorporation of dispersants in undully large amounts and prove uneconomical.

An object of this invention, therefore, is to provide a novel dispersant for an aqueous carbonaceous solid slurry and an aqueous carbonaceous solid slurry composition produced by incorporation of the dispersant.

Another object of this invention is to provide a dispersant for easy preparation of an aqueous carbonaceous solid slurry possessing flowability even in a highly concentrated state.

DISCLOSURE OF THE INVENTION

The objects described above are accomplished by this invention providing a dispersant for an aqueous carbonaceous solid slurry, comprising a water-soluble copolymer having an average molecular weight of 1,000 to 500,000 and obtained by polymerizing the following monomer components (A), (B), (C), and (D) and/or a water-soluble copolymer obtained by neutralizing said copolymer with a basic substance:

(A) 0.1 to 7 mol % of a polyalkylene glycol mono(meth) acrylate type monomer represented by the general formula I:

$$CH_2{=}\overset{\overset{\displaystyle R^1}{|}}{C}{-}COO{\leftarrow}R^2O{\rightarrow}_n R^3 \qquad (I)$$

wherein $R^1$ stands for hydrogen atom or methyl group, $R^2$ for alkylene group having 2 to 4 carbon atoms, n for a numeral in the range of 1 to 100 on the average, and $R^3$ for alkyl, alkenyl, or aryl group having 1 to 30 carbon atoms, alkyl, cyclic alkyl, or cyclic alkenyl group possessing an aryl group as a substituent, or a monovalent organic group derived from a heterocyclic compound, (B) 5 to 94.9 mol % of a sulfoalkyl (meth)acrylate type monomer represented by the general formula II:

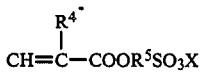

(II)

wherein $R^4$ stands for hydrogen atom or methyl group, $R^5$ for alkylene group having 1 to 4 carbon atoms and X for hydrogen atom, alkali metal atom, alkaline earth metal atom, ammonium group, or an amine base, (C) 5 to 94.9 mol % of an unsaturated carboxylic acid type monomer represented by the general formula III:

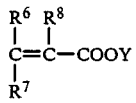

(III)

wherein $R^6$ and $R^7$ independently stand for hydrogen atom, methyl group, or —COOY, providing that $R^6$ and $R^7$ do not simultaneously stand for —COOY, $R^8$ stands for hydrogen atom, methyl group, —COOY, or $—CH_2COOY$, providing that $R^6$ and $R^7$ independently stand for hydrogen atom or methyl group where $R^8$ stands for —COOY or $—CH_2COOY$, and Y stands for hydrogen atom, alkali metal atom, alkaline earth metal atom, ammonium group, or amine base, and (D) 0 to 20 mol % of other monomer (providing that the total amount of the monomer components (A), (B), (C), and (D) is 100 mol %).

The objects described above are further accomplished by this invention providing an aqueous carbonaceous solid slurry composition having incorporated in 100 parts by weight of a carbonaceous solid 0.01 to 5 parts by weight of the aforementioned dispersant.

BEST MODE OF CARRYING OUT THE INVENTION

Figure 1:
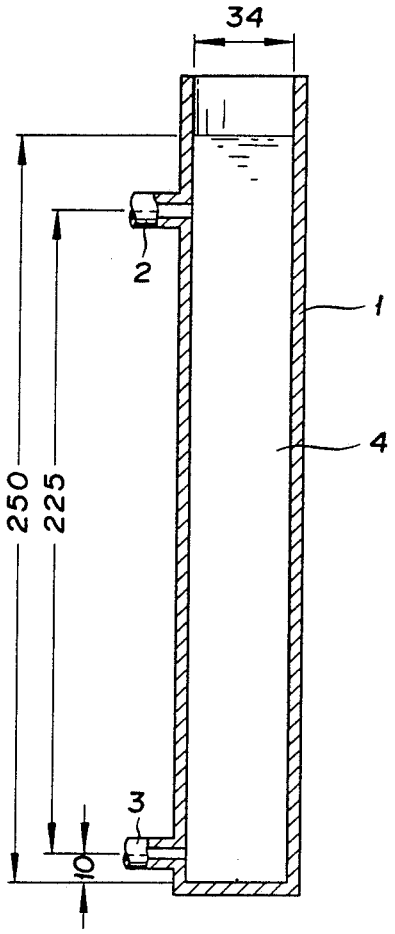
FIG. 1 is a schematic cross section of an apparatus for determining the condition of solid separation in an aqueous coal slurry.

As examples of the carbonaceous solid to be used in the aqueous carbonaceous solid slurry composition contemplated by the present invention, coal, cokes such as coal coke, oil coke and the like, and pitches such as petroleum pitch, coaltar pitch and the like can be cited. Among other carbonaceous solids mentioned above, coal proves particularly effective. This coal may be any of the various kinds of coal such as, for example, anthracite (rock coal) bituminous coal, subbituminous coal, and lignite. This invention does not discriminate the coal by the kind or the origin or by the water content or the chemical composition. The coal is used as the standard in a form pulverized by the conventional wet or dry method into fine particles, of which not less than 50% by weight, preferably 70 to 90% by weight, will pass a 200-mesh sieve. The fine coal powder concentration in the slurry composition is in the range of 40 to 90% by weight, preferably 50 to 90% by weight, on dry basis. If the concentration is less than 40% by weight, the aqueous slurry composition is not practical from the viewpoints of economy, efficiency of transportation, and efficiency of combustion.

The water-soluble copolymer which is effective as a dispersant for the aqueous carbonaceous solid slurry contemplated by the present invention is a water-soluble copolymer having an average molecular weight of 1,000 to 500,000 and produced by copolymerizing the aforementioned monomers (A), (B), (C), and (D) in proportions such that the amount of the monomer (A) falls in the range of 0.1 to 7 mol %, that of the monomer (B) in the ranqe of 5 to 94.9 mol %, that of the monomer (C) in the range of 5 to 94.9 mol %, and that of the monomer (D) in the range of 0 to 20 mol % (providing that the total amount of the monomers (A), (B), (C), and (D) is 100 mol %) and /or a water-soluble copolymer obtained by neutralizing the copolymer with a basic substance.

The monomer (A) is represented by the aforementioned general formula I and can be obtained by the known method. Examples of the monomer (A) include methoxypolyethylene glycol (meth)acrylate, methoxypolypropylene glycol (meth)acrylate, methoxypolybutylene glycol (meth)acrylate, ethoxypolyethylene glycol (meth)acrylate, ethoxypolypropylene glycol (meth)acrylate, ethoxypolybutylene glycol (meth)acrylate, and methoxypolyethylene glycolpolypropylene glycol (meth)acrylate; alkoxypolyalkylene glycol (meth)acrylates alkoxylated with alkyl groups having up to 30 carbon atoms; alkenoxypolyalkylene glycol (meth)acrylates alkenoxylated with alkenyl groups having up to 30 carbon atoms; aryloxypolyalkylene glycol (meth)acrylates such as phenoxypolyethylene glycol (meth)acrylate, nonylphenoxypolyethylene glycol (meth)acrylate, naphthoxypolyethylene glycol (meth)acrylate, phenoxypolypropylene glycol (meth)acrylate, naphthoxypolyethylene glycolpolypropylene glycol (meth)acrylate, and p-methylphenoxypolyethylene glycol (meth)acrylate; aralkyloxypolyalkylene glycol (meth)acrylates such as phenoxypolyethylene glycol (meth)acrylate, nonylphenoxypolyethylene glycol (meth)acrylate, naphthoxypolyethylene glycol (meth)acrylate, phenoxypolypropylene glycol (meth)acrylate, naphthoxypolyethylene glycol-polypropylene glycol (meth)acrylate, and p-methylphenoxypolyethylene glycol (meth)acrylate; aralkyloxypolyalkylene glycol (meth)acrylates such as benzyloxypolyethylene glycol (meth)acrylate; cyclic alkoxypolyalkylene glycol (meth)acrylates such as cyclohexoxypolyethylene glycol (meth)acrylate; cyclic alkenoxypolyalkylene glycol (meth)acrylates such as cyclopentanoxypolyethylene glycol (meth)acrylate; and heterocyclic ethers of polyalkylene glycol (meth)acrylate such as pyridyloxypolyethylene glycol (meth) acrylate and thienylxypolyethylene glycol (meth)acrylate. One member or a mixture of two or more members selected from the group of the monomers enumerated above can be used. In all the monomers of (A) usable in the present invention, the monomers which readily yield to the aforementioned copolymerization and are available inexpensively and, therefore, prove particularly desirable are those which meet the general formula I on the condition that $R^1$ stands for hydrogen atom or methyl group, $R^2$ for ethylene group or propylene group, n for a numeral in the range of 2 to 50 on the average, and $R^3$ for alkyl, phenyl, or naphthyl group having 1 to 20 carbon atoms, or alkylphenyl group or benzyl group possessing 1 to 3 alkyl groups each of 1 to 10 carbon atoms as a substituent. Typical examples of the monomers (A) just described include methoxypolyethylene glycol (meth)acrylate, methoxypolypropylene glycol (meth)acrylate, ethoxypolyethylene glycol (meth)acrylate, ethoxypolypropylene glycol (meth)acrylate, octyloxypolyethylene glycol (meth)acrylate, and methoxypolyethylene glycolpolypropylene glycol (meth)acrylate; alkoxypolyethylene glycol (meth)acrylates alkoxylated with alkyl groups having up to 20 carbon atoms; alkoxypolypropylene glycol (meth)acrylates; phnoxypolyethylene glycol (meth)acrylate, p-methylphenoxypolyethylene glycol (meth)acrylate, nonylphnoxypolyethylene glycol (meth)acrylate, octylphenoxypolyethylene glycol (meth)acrylate, naphthoxypolyethylene glycol (meth)acrylate, phenoxypolypropylene glycol (meth)acrylate, p-methylphenoxypolypropulene glycol (meth) acrylate, benzyloxypolyethylene glycol (meth)acrylate, and benzyloxypolypropylene glycol (meth)acrylate. One member or a mixture of two or more members selected from the group of monomers enuemrated above can be used.

The monomer (B) is represented by the general formula II and can be produced by the known method. Examples of the monomer (B) include 2-sulfoethyl (meth)acrylate, 3-sulfopropyl (meth)acrylate, 2-sulfopropyl (meth)acrylate, 1-sulfopropan-2-yl (meth)acrylate, and 4-sulfobutyl (meth)acrylate, sodium, potassium, and other alkali metal salts and magnesium, calcium, and other alkaline earth metal salts of such (meth)acrylates, and ammonium salts and organic amine salts thereof. One member or a mixture of two or more members selected from the group of monomers cited above can be used. Examples of the amine for the formation of the amine salts mentioned above include alkyl amines such as methyl amine, dimthyl amine, trimethyl amine, ethyl amine, diethyl amine, triethyl amine, n-propyl amines, isopropyl amines, and butyl amines; alkanol amines such as ethanol amine, diethanol amine, triethanol amine, isopropanol amine, and diisopropanol amine; and pyridine. In the monomers of (B) enuemrated above, the monomers which are available easily and capable of producting the copolymer of particularly desirable properties and, therefore, prove particularly desirable are those which satisfy the general formula II on the condition that $R^4$ stands for hydrogen atom or methyl group, $R^5$ for ethylene group or propylene group, and X for hydrogen atom, sodium atom, potassium atom, ammonium group, or alkanol amine base. Preferably, the alkanol base is monoethanol amine base, diethanol amine base, or triethanol amine base.

The monomer (C) is represented by the general formula III and can be obtained similarly by the known method. Examples of the monomer (C) include acrylic acid, methacrylic acid, crotonic acid, itaconic acid, maleic acid, fumaric acid, and citraconic acid, and alkali metal salts, alkaline earth metal salts, ammonium salts, and organic amine salts of the acids mentioned above. One member or a mixture of two or more members selected from the group of monomers cited above can be used. Examples of the amine for the formation of the amine salts mentioned above are similar to those mentioned previously with respect to the monomers of the general formula II. In the monomers of (C) enumerated above, the monomers which are available inexpensively and capable of imparting satisfactory dispersibility to the produced copolymer are maleic acid and (meth) acrylic acid and sodium salts, potassium salts, ammonium salts, monoethanol amine salts, diethanol amine salts, triethanol amine salts, and other similar alkanol amine salts of the acids mentioned above.

The monomer (D) has only to be copolymerizable with the monomers (A), (B), and (C) and can be used in a proportion incapable of impairing the effect of this invention. Examples of the monomer (D) include alkyl (meth)acrylates such as methyl (meth)acrylate, ethyl (meth)acrylate, isopropyl (meth)acrylate, butyl (meth)acrylate, and lauryl (meth)acrylate; cyclohexyl (meth)acrylate; various sulfonic acids such as vinyl sulfonic acid, styrene sulfonic acid, alkyl sulfonic acid, methallyl sulfonic acid, and 2-acrylamide-2-methylpropane sulfonic acid, i.e. other than the sulfonic acids falling under the category of the monomer (B), alkali metal salts, alkaline earth metal salts, ammonium salts, and organic amine salts of the acids mentioned above; hydroxyl group-containing monomers such as hydroxyethyl (meth)acrylate, hydroxypropyl (meth)acrylate, and polyethylene glycol (meth)acrylate; various (meth)acrylamides such as (meth)acrylamide and N-methylol (meth)acrylamide; aromatic vinyl compounds such as styrene and p-methylstyrene; and vinyl acetate, propenyl acetate, and vinyl chloride. One member or a mixture of two or more members selected from the group of monomers mentioned above can be used.

In the preparation of the water-soluble copolymer by the copolymerization of these monomers (A), (B), (C), and optionally (D), the monomers are used in proportions such that the amount of the monomer (A) falls in the range of 0.1 to 7 mol %, preferably 0.2 to 5 mol %, that of the monomer (B) in the range of 5 to 94.9 mol %, preferably 10 to 89.8 mol %, that of the monomer (C) in the range of 5 to 94.9 mol %, preferably 10 to 89.8 mol %, and that of the monomer (D) in the range of 0 to 20 mol %, preferably 0 to 10 mol % (providing that the total amount of the monomers (A), (B), (C), and (D) is 100 mol %). If the monomers are used in amounts deviating from the respective ranges specified above, the produced water-soluble copolymer exhibits an insufficient quality for use as a dispersant for the aqueous carbonaceous solid slurry. Particularly when the monomer (A) is used in an amount either below 0.1 mol % or above 7 mol %, the produced copolymer exhibits no sufficient dispersing property to the coal without reference to the kind thereof. When the monomer (B) is used in an amount below 5 mol %, the produced copolymer exhibits a notably lowered dispersing property to the coal of a high ash content containing polyvalent metals in a large amount. When the monomer (C) is used in an amount below 5 mol %, the produced copolymer exhibits a notably low dispersing property to the coal having a low ash content of not more than 3% by weight (on the anhydrous basis) or the coal of a high degree of carbonization. It is only when the monomers (A), (B), (C), and optionally (D) are used within the respective ranges specified above that the produced water-soluble copolymer is capable of manifesting the outstanding dispersing property on the carbonaceous solid without reference to the kind and the quality thereof, such as, for example, the ash content, the water content, and the chemical composition thereof.

For the production of a water-soluble copolymer which is useful as the dispersant for the aqueous carbonaceous solid slurry of the present invention, it suffices to copolymerize the monomer components in the presence of a polymerization initiator. The copolymerization can be carried out by polymerization in a solvent, bulk polymerization, or some other similar method.

The polymerization in a solvent can be performed batchwise or continuously. Examples of the solvent usable in this polymerization include water; lower alcohols such as methyl alcohol, ethyl alcohol, and isopropyl alcohol; aromatic, aliphatic, and heterocyclically aliphatic hydrocarbons such as benzene, toluene, xylene, cyclohexane, n-hexane, and dioxane; ethyl acetate; and ketones such as acetone, and methylethyl ketone. In consideration of the solubility of the monomers used as raw materials and the copolymer as a product and the convenience of use of the copolymer it is desirable to use at least one member selected from the group consisting of water and lower alcohols having 1 to 4 carbon atoms. In the lower alcohols of 1 to 4 carbon atoms, methyl alcohol, ethyl alcohol, and isopropyl alcohol are particularly effective selections.

When the polymerization is carried out in water as the medium, the polymerization initiator to be used therein may be any of the initiators of conventional use. For example, a water-soluble polymerization initiator such as ammonium or alkali metal persulfate or hydrogen peroxide can be used. In this case, an accelerating agent such as sodium hydrogen sulfite may be used in combination with the polymerization initiator. For the polymerization using a lower alcohol, an aromatic hydrocarbon, an aliphatic hydrocarbon, ethyl acetate, or a ketone compound as the solvent, any of the initiators of conventional use can be used. Examples of the polymerization initiator usable therein include peroxides such as benzoyl peroxide and lauroyl peroxide; hydroperoxide such as cumene hydroperoxide; and aliphatic azo compounds such as azo-bisisobutyronitrile. The amount of the polymerization initiator to be used is in the range of 0.1 to 10% by weight, preferably 0.2 to 5% by weight, based on the total amount of the monomers being used in the polymerization. In this case, an accelerating agent such as an amine compound may be used in combination with the polymerization initiator. When a mixed solvent consisting of water and a lower alcohol is used, a polymerization initiator or a combination of a polymerization initiator with an accelerating agent may be suitable selected from the various polymerization initiators and accelerating agents mentioned above and put to use therein. The polymerization temperature is suitably fixed, depending on the particular kinds of solvent and polymerization initiator to be used. Generally the polymerization is carried out at a temperature in the range of 0° to 120° C., preferably 20° to 100° C.

The bulk polymerization requires use of a polymerization initiator which may be a peroxide such as benzoyl peroxide or lauroyl peroxide, a hydroperoxide such as cumene hydroperoxide, or an aliphatic azo compound such as azo-bis-isobutyronitrile. It is carried out at a temperature in the range of 50° to 150° C. The amount of the polymerization initiator to be used therein is in the range of 0.1 to 10% by weight, preferably 0.2 to 5% by weight, based on the total amount of the monomers being used in the polymerization.

Desirably, the water-soluble copolymer has a molecular weight in the range of 1,000 to 500,000, preferably 5,000 to 300,000.

The water-soluble copolymer which is obtained by the copolymerization performed as described above can be used in its unmodified form as the dispersant of this invention for the aqueous carbonaceous solid slurry. Optionally, it may be neutralized with a basic substance before it is put to use as the dispersant. As examples of the basic substance usable for the neutralization, hydroxides, oxides, and carbonates of alkali metals and alkaline earth metals, ammonia, and organic amines can be cited. Examples of the organic amines include alkyl amines such as methyl amine, dimethyl amine, trimethyl amine, ethyl amine, diethyl amine, triethyl amine, n-propyl amines, isopropye amines, and butyl amines; alkanol amines such as ethanol amine diethanol amine, triethanol amine, isopropanol amine, and diisopropanol amine; and pyridine.

The dispersant of this invention for an aqueous carbonaceous solid slurry serves to combine a carbonaceous solid with water and give rise to an aqueous carbonaceous solid slurry composition contemplated by this invention. The amount of the dispersant to be added in this case is not specifically limited. The dispersant can be used effectively in an amount to be selected in a wide range. From the economic point of view, however, it is used generally in an amount in the range of 0.01 to 5 parts by weight, desirably 0.05 to 2 parts by weight, and more desirably 0.1 to 1 part by weight, based on 100 parts by weight of the carbonaceous solid (on dry basis).

The carbonaceous solid content in the aqueous carbonaceous solid slurry composition of this invention is not specifically limited. With consideration to the efficiency of transportation and the efficiency of combustion of the composition, this content is generally desired to fall in the range of 40 to 90% by weight, preferably in the range of 50 to 90% by weight, and more preferably in the range of 55 to 85% by weight.

The production of the aqueous carbonaceous solid slurry composition by the use of the dispersant of this invention for an aqueous carbonaceous solid slurry may be accomplished by admixing a preparatorily pulverized carbonaceous solid and water with the dispersant and then converting the resulting mixture into a slurry by means of kneading, for example, or by wet-pulverizing a carbonaceous solid with water and the dispersant or solution thereof, and converting the resulting mixture into a slurry as by means of kneading. The dispersant may be used all at once in a prescribed amount or may be used piecemeal as split in a plurality of portions and remainder is added during pulverization or kneading.

During the wet-pulverization, the post-kneading is sometimes unnecessary, because kneading is carried out at the same time.

At pulverization or kneading stabilizing agents and/or dispersion aids are sometimes added during pulverization or kneading. The stabilizing agents are preferably added during kneading. The stabilizing agents and the dispersion aids may be used piecemeal as split in a plurality of portions.

The apparatus to be used for the conversion of the mixture into a slurry may be any of the devices conventionally available for converting a carbonaceous solid into a slurry with water.

The present invention does not discriminate the aqueous carbonaceous solid slurry composition thereof by the manner of incorporation of the dispersant or by the manner of conversion of the mixture into a slurry.

The aqueous carbonaceous solid slurry composition of the present invention, when necessary, may incorporate therein a polymer, a surfactant, or a fine inorganic powder as a dispersion aid or stabilizer besides the aforementioned water-soluble copolymer. When the dispersant of this invention is used in combination with a suitably selected dispersion aid or stabilizer, the aqueous carbonaceous solid slurry composition aimed at can be obtained in a higher concentration with high flowability. Further, this composition enjoys improved stability to withstand the effect of aging and manifests a desirable quality of precluding the otherwise inevitable phenomenon of solid-liquid separation even after a protracted standing. The suitably selected dispersion aid or stabilizer can be used effectively in combination with the dispersant of this invention without entailing such an obstacle as agglomeration of the carbonaceous solid particles in the slurry.

Examples of the dispersion aid to be used in combination with the dispersant of the present invention for producing an aqueous carbonaceous solid slurry composition having high flowability and excelling in stability to withstand the effect of aging include polystyrene sulfonic acid or salts thereof, styrene-styrene sulfonic acid copolymer or salts thereof, sulfonates of naphthalene and creosote oil, salts thereof, or aliphatic aldehyde addition condensates thereof, aliphatic aldehyde condensates of sulfonate group-containing amino triazines and salts thereof, compounds containing a tricyclodecane or tricyclodecene skeleton and a sulfonate group as essential components in the molecular unit thereof, and polyether compounds obtained by adding alkylene oxides to formalin condensates of alkylphenols, and one or more than one kinds of these compounds can be used.

The polystyrene sulfonic acid or salts thereof or the styrene-styrene sulfonic acid copolymer or salts thereof is obtained by polymerizing a monomeric styrene sulfonic acid or by copolymerizing styrene with styrene sulfonic acid, or then by neutralizing the polymer or the copolymer obtained with basic substances. Otherwise, the polymer or copolymer may be obtained by sulfonating polystyrene by the conventional method. Desirably, the salt of sulfonic acid radical is an alkali metal or ammonium salt. It may contain a partially residual hydrogen. It may otherwise be an alkaline earth metal salt or an amine salt. The molecular weight of this salt is desired to exceed 1,000, preferably to fall in the range of 2,000 to 50,000.

The sulfonate of naphthalene or creosote oil, the salt thereof, or the aliphatic aldehyde addition condensate thereof is obtained by subjecting a sulfonation product to addition condensation with an aliphatic aldehyde or by effecting this addition condensation and subsequently sulfonating the addition condensate. Among other products of the addition condensation, those obtained by formalin condensation prove to be particularly effective. The degree of condensation is desired to fall in the range of 1.2 to 60, preferably 1,2 to 50. If the degree of condensation is less than 1.2, the effect of the condensation is not sufficient. Conversely, if this degree exceeds 60, the produced condensate proves to be impracticable because of excessive polymerization and insufficient solubility. Examples of the salt of sulfonate include salts of alkali metals such as sodium and potassium, salts of alkaline earth metals such as calcium and magnesium, ammomium salts, and amine salts. The term "creosote oil" refers to the neutral oil of a boiling point of not lower than 200° C. contained in the tar from coal carbonization or to an alkylation product of the neutral oil. Heretofore, the creosote oil has been defined in various ways. According to Japanese Industrial Standard (JIS) K 2439 (1978), it is a product obtained by separating crystalline components such as naphthalene and anthracene from a mixture of distillates of grades of not lower than middel oil, i.e. such distillates as middle oil, heavy oil, and anthracene oil, resulting from distillation of coal tar, further separating and recovering phenols and pyridines, and suitably combining the remaining distillates in a fixed formula. The product is classified into three kinds, No. 1, No. 2, and No. 3. Creosote oil, No. 1, for example, is a mixture of a plurality of compounds which has a specific gravity of not less than 1.03 and a water content of not more than 3% and which has a fraction of not more than 25% boiling at temperatures not exceeding 235° C., a fraction of not less than 40% boiling at temperatures between 235° and 315° C., and a fraction of not less than 50% distilling out at temperatures not exceeding 315° C.

The creosote oil defined by JIS K 2439 (1978) mentioned above can be used in its unmodified form of a mixture of a plurality of component compounds. Distillates obtained by distilling the creosote oil such as, for example, the fractions boiling at 200° C. to 250° C., 240° C. to 260° C., 250° C. to 270° C., and 270° C. to 300° C. are all usable. The creosote oil and distillates may be alkylated before they are put to use. The method to be used for effecting this alkylation is not specifically defined. For example, a method which effects sulfonation and alkylation simultaneously by allowing the sulfonation by the use of fuming sulfurinc acid or concentrated sulfuric acid to proceed in the presence of a corresponding alcohol may be used.

The condensation product of a sulfonate group-containing amino-triazine with an aliphatic aldehyde or the salt thereof is an amino-triazine condensate or the salt thereof. Examples of the salt of sulfonate group usable for the condensation include alkali metal salts, alkaline earth metal salts, ammonium salts, and amine salts. One example of the condensation product is a condensate produced by the procedure described in Japanese Patent Publication SHO No. 43(1968)-21,659. This condensate is generally produced by condensing an amino-s-triazine such as, for example, melamine, hexamethylol melamine, acetoguanamine, or benzoguanamine in the presence of an aliphatic aldehyde, preferably formaldehyde and subsequently sulfonating the resulting condensation product with a sulfonating agent such as, for example, sulfurous acid, sulfuric acid, sulfonic acid, hydrogen sulfite, or a salt thereof, disulfite, dithionite, or pyrosulfite or by condensing an amino-striazine sulfonic acid with an aldehyde, preferably formaldehyde. The sulfonated melamine resin which is one of the preferred embodiments of this invention is a sulfonate group-containing condensation product obtained by chemical addition of $Na_2S_2O_3$ (or $NaHSO_3$) to melamine and formaldehyde.

The compound containing a tricyclodecene skeleton and a sulfonate group as essential components in the molecular unit thereof is at least one of the following compounds (1) through (6). In this invention, the tricyclodecane skeleton and tricyclodecene skeleton have the following structures (IV) and (V) (namely, they are tricyclo-[5.2.1.$0^{2,6}$]-decane and decene).

(IV)

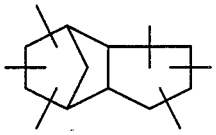

-continued (V)

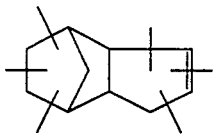

(1) The sulfonate obtained by polymerizing a cyclopentadiene or a cyclopentadiene derivative represented by the general formula (a) or general formula (b) as shown in Japanese Patent Application SHO No. 57(1982)35,148 and sulfonating the resultant polymer.

(a)

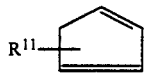

wherein $R^{11}$ stands for hydrogen atom or alkyl group having 1 to 3 carbon atoms, (b)

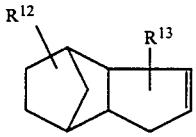

wherein $R^{12}$ and $R^{13}$ independently stand for hydrogen atom or alkyl group having 1 to 3 carbon atoms.

(2) The sulfonate obtained by causing a cyclopentadiene or a cyclopentadiene derivative represented by the general formula (a) or general formula (b) as shown in Japanese Patent Application SHO No. 57(1982)-35,149 to react with a compound represented by the general formula (c) and sulfonating the resulting reaction mixture or the condensate of the sulfonate.

(c)

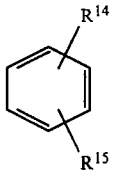

wherein $R^{14}$ and $R^{15}$ independently stand for hydrogen atom or alkyl group having 1 to 6 carbon atoms.

(3) The condensate obtained by condensing a cyclopentadiene derivative sulfonate represented by the general formula (d) as shown in Japanese Patent Application SHO No. 57(1982)-35,147.

(d)

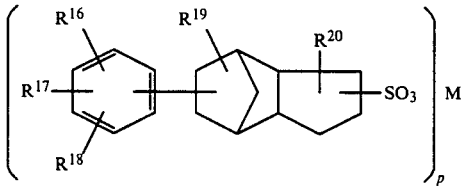

wherein $R^{16}$, $R^{17}$, and $R^{18}$ independently stand for a hydrogen atom or an alkyl group having 1 to 6 carbon atoms, $R^{19}$ and $R^{20}$ independently stand for a hydrogen atom or an alkyl group having 1 to 3 carbon atoms, p stands for 1 or 2, and M stands for hydrogen, alkali metals, alkaline earth metals, ammonium group, or amine group.

(4) The polymer or copolymer of a sulfonate of dicyclopentadiene represented by the general formula (e) shown in Japanese Patent Application SHO No. 57(1982)-175,666.

(e)

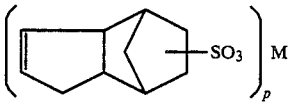

wherein p and M have the same meanings as defined in the formula (d) above.

(5) The polymer or the copolymer of a sulfonate of hydroxydicyclopentadiene represented by the general formula (f) as shown in Japanese Patent Application SHO No. 58(1973)-43,729.

(f)

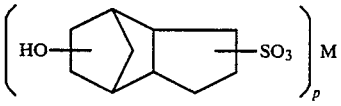

wherein p and M have the same meanings as defined in the formula (d) above.

(6) The condensate obtained by condensing a disulfonate of dicyclopentadiene derivative represented by the general formula (g) as shown in Japanese Patent Application SHO No. 58(1973)-42,205.

(g)

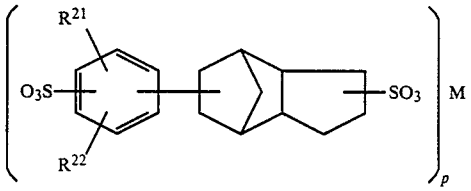

wherein $R^{21}$ and $R^{22}$ independently stand for a hydrogen atom or an alkyl group having 1 or 2 carbon atoms and M and p have the same meanings as defined in the formula (d) above.

Concrete compounds which can be represented by the general formula (a) or general formula (b) in the paragraph (1) above include alkylcyclopentadienes such as methylcyclopentadiene, ethylcyclopentadiene, and propylcyclopentadiene besides cyclopentadiene and dimers of any of combinations of such monomers such as, for example, dicyclopentadiene. Among other concrete compounds cited above, cyclopentadiene and dicyclopentadiene and the mixture of the two compounds prove particularly desirable. Concrete compounds which can be represented by the general formula (c) in the paragraph (2) above include benzene, toluene, xylenes (o-, m-, and p-), and benzene derivatives such as ethyl benzene, n-propyl benzene, isopropyl benzene, methylethyl benzenes (o-, m-, and p-), n-butyl benzene, sec-butyl benzene, tert-butyl benzene, isopropyl toluenes (o-, m-, and p-), amyl benzene, amyl toluenes (o-, m-, and p-), and other similar mono- and dialkyl-substituted benzenes. Among other typical compounds cited above, benzene, toluene, xylene, propyl benzene, and butyl benzene prove particularly desirable.

Among the polyether compounds obtained by adding alkylene oxides to formalin condensates of alkylphenols, following compounds represented by the general formula are preferable:

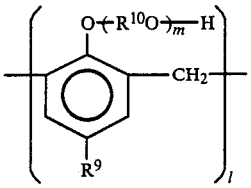

wherein $R^9$ stands for an alkyl group of 5 to 12 carbon atoms, $(R^{10}O)_m$ for ethylene oxide or a block polymer of propylene oxide with ethylene oxide, m for a numeral in the range of 1 to 100 in the case of ethylene oxide alone or in the range of 1 to 12 in the case of the block polymer of propylene oxide with ethylene oxide, the content of ethylene oxide is in the range of 30 to 95 mol %, and 1 for the degree of condensation in the range of 2 to 50.

The polyether compounds obtained by adding alkylene oxides to formalin condensates of alkylphenols is a formalin condensate of polyoxyalkylene alkylphenol having a molecular weight of 1,000 to 600,000, preferably 5,000 to 300,000, and obtained by using as a starting material a formalin condensate having an average condensation degree of 2 to 50, preferably 7 to 40, and resulting from formalin condensation of an alkyl phenol in the absence of a solvent, mixing the starting material with a hydrocarbon oil having a boiling point of not lower than 150° C. and serving as an oil for the improvement of the reactivity of alkylene oxide, and chemically adding an alkylene oxide to the resulting mixture.

Advantageously, the dispersion aid which can be used in combination with the dispersant of the present invention is used in an amount in the range of 0.01 to 5 parts by weight, preferably 0.02 to 2 parts by weight, based on 100 parts by weight of the carbonaceous solid.

Examples of the stabilizing agent which can be advantageously used in combination with the dispersant of the present invention during the production of the aqueous carbonaceous solid slurry composition of the present invention include clayish minerals, polysaccharides, and alkali metal salts of polyacrylic acid. One member or a mixture of two or more members selected from the group of stabilizing agents cited above can be used.

The clayish minerals, i.e. hydrated aluminasilicates, fall under various types such as the montmorillonite family, the kaolin family, and the illite family. Among other clayish minerals, those of the montmorillonite family prove particularly desirable.

Typical examples of the polysaccharide include microorganic polysaccharides such as xanthane gum, glycosaminoglycan, mannans, carboxymethyl cellulose, alkali metal salts thereof, and hydroxyethyl cellulose. Among other polysaccharides enumerated above, the sodium salt of carboxymethyl cellulose (CMC), hydroxyethyl cellulose (HEC) and xanthane gum prove particularly desirable. The CMC uses cellulose (pulp), monochloroacetic acid, and sodium hydroxide as main raw materials and acquires solubility in water by having a hydrophilic sodium carboxymethyl group (—$CH_2COONa$) incorporated in the cellulose. Specifically, it is produced by first causing sodium hydroixde to react upon cellulose thereby forming alkali cellulose and subsequently allowing monochloroacetic acid to react upon the alkali cellulose thereby inducing etherification of the hydroxyl group of the cellulose and consequent incorporation of a carboxymethyl group in the cellulose. In this case, it is theoretically possible to produce CMC of the etherification degree of 3, i.e. to have all the three hydroxyl groups of each cellulose unit etherified completely. Most CMC products available in the market generally have degrees of etherification in the range of 0.5 to 1.5. The HEC uses cellulose (pulp), ethylene oxide, and sodium hydroxide as main raw materials and acquires solubility in water by addition of a hydrophilic hydroxyethyl group (—$CH_2CH_2OH$) to the cellulose. Specifically, it is produced by first causing sodium hydroxide to react upon cellulose thereby forming alkali cellulose and subsequently allowing ethylene oxide to react upon the alkali cellulose thereby inducing conversion of the hydroxyl group of cellulose into hydroxyethyl group through the medium of an ether bond and giving rise to water-soluble hydroxyethyl cellulose.

In all the alkali metal salts of polyacrylic acid, polysodium acrylate proves particularly desirable as a stabilizer.

The stabilizer of the foregoing description which can be used in combination with the dispersant of the present invention is used in an amount in the range of 0.0001 to 2.0 parts by weight, preferably 0.0005 to 1.0 part by weight, based on 100 parts by weight of the carbonaceous solid.

It is optional to use the dispersant of the present invention in combination with both the dispersion aid and the stabilizer mentioned above.

The aqueous carbonaceous solid slurry composition of this invention can contain therein a basic substance as a pH adjusting agent in addition to the dispersant used as an essential component and the dispersion aid and the stabilizer used as optional additives. For the aqueous carbonaceous solid slurry composition to acquire high flowability, the pH of the composition is desired to be in the range of 4 to 11, preferably 6 to 10. This composition can be produced in a high concentration with high flowability by additionally using therein the pH adjusting magnet in an amount suitably selected for the pH value of the composition to fall in the range mentioned above.

The pH adjusting agent of the foregoing description which can be used in combination with the dispersant of this invention must be used suit the pH value of the aqueous carbonaceous solid slurry composition. Desirably, the pH adjusting agent is used in an amount in the range of 0.01 to 5 parts by weight, preferably 0.05 to 0.5 part by weight, based on 100 parts by weight of the carbonaceous solid.

Examples of the pH adjusting agent which can be optionally incorporated during the preparation of the aqueous carbonaceous solid slurry composition of the present invention include basic substances such as hydroxides, oxides, and carbonates of alkali metals, hydroxides, oxides, and carbonates of alkaline earth metals, ammonia, and organic amines. Among the pH adjusting agents cited above, sodium hydroxide, potassium hydroxide, calcium hydroxide, magnesium hydroxide, ammonia, ethanol amine, diethanol amine, and triethanol amine prove particularly desirable.

The aqueous carbonaceous solid slurry composition of the present invention, when necessary, can additionally incorporate therein a rust preventive, a corrosion proofing agent, an antioxidant, a defoaming agent, an antistatic agent, and a solubilizing agent.

Now, the aqueous carbonaceous solid slurry composition of the present invention will be described more specifically with reference to comparative experiments and working examples. It should be noted, however, that this invention is not limited to these working examples Wherever "parts" is mentioned hereinafter, the term will mean "parts by weight" unless otherwise specified.

REFERENTIAL EXAMPLE 1

In a polymerization vessel fitted with a thermometer, a stirrer, two dropping funnels, a gas inlet tube, and a reflux condenser 100 parts of water placed therein were stirred and the inner gas of the polymerization vessel was displaced with nitrogen. Then, in the atmosphere of nitrogen the water was heated to 95° C. Subsequently, to the hot water kept at this temperature, a monomer mixture solution containing 2.1 parts of methoxypolyethylene polyethylene glycol methacrylate (containing an average of 15 ethylene oxide units per molecule and having an average molecular weight of 760) as monomer (A), 80.21 parts of sodium salt of 2-sulfoethyl methacrylate (having a molecular weight of 216) as monomer (B), 17.7 parts of sodium methacrylate (having a molecular weight of 108) as monomer (C), and 150 parts of water was added dropwise through one of the dropping funnels over a period of 120 minutes. At the same time, an aqueous solution containing 0.8 part of ammonium persulfate and 50 parts of water was added dropwise through the other dropping funnel to the same hot water over a period of 140 minutes. After the dropwise addition was completed, polymerization already initiated was continued at the same temperature for 60 minutes and then cooled. Consequently, there was obtained a copolymer (1) having an average molecular weight of 60,000.

REFERENTIAL EXAMPLE 2

A copolymer (2) having an average molecular weight of 40,000 was obtained by following the procedure of Referential Example 1, excepting 2.7 parts of methoxypolyethylene glycol methacrylate (containing an average of 6 ethylene oxide units per molecule and having an average molecular weight of 364) was used as monomer (A), 57.5 parts of ammonium salt of 2-sulfoethyl acrylate (having a molecular weight of 197) was used as monomer (B), 39.9 parts of ammonium acrylate (having a molecular weight of 89) was used as monomer (C), and the amount of ammonium persulfate was changed to 1.5 parts.

REFERENTIAL EXAMPLE 3

A copolymer (3) was obtained by preparing a copolymer having an average molecular weight of 200,000 following the procedure of Referential Example 1, excepting 1.9 parts of ethoxypolyethylene glycol acrylate (containing an average of 15 ethylene oxide units per molecule and having an average molecular weight of 760) was used as monomer (A), 91.9 parts of sodium salt of 2-sulfoethyl methacrylate (having a molecular weight of 216) was used as monomer (B), 6.2 parts of methacrylic acid (having a molecular weight of 86) was used as monomer (C), and the amount of ammonium persulfate was changed to 0.4 part, and subsequently neutralizing the copolymer with 4.4 parts of monoethanol amine.

REFERENTIAL EXAMPLE 4

A copolymer (4) was obtained by preparing a copolymer having an average molecular weight of 60,000 following the procedure of Referential Example 1, excepting 6.4 parts of n-propoxypolyethylene glycol-polypropylene glycol acrylate (having an average of 20 ethylene oxide units and an average of 5 propylene oxide units per molecule and having an average molecular weight of 1,284) was used as monomer (A), 71.7 parts of potassium salt of 2-sulfopropyl acrylate (having a molecular weight of 232) was used as monomer (B), 21.0 parts of acrylic acid (having a molecular weight of 72) was used as monomer (C), and 0.9 part of acryl amide (having a molecular weight of 71) was additionally used as monomer (D), and the amount of ammonium persulfate was changed to 1 part, and subsequently neutralizing the copolymer with 16.4 parts of potassium hydroixde.

REFERENTIAL EXAMPLE 5

A copolymer (5) was obtained by following the procedure of Referential Example 1, excepting 2.0 parts of octyloxypolyethylene glycol acrylate (containing an average of 30 ethylene oxide units per molecule and having an average molecular weight of 1,504) was used as monomer (A), 54.4 parts of sodium salt of 2-sulfoethyl acrylate (having a molecular weight of 202) was used as monomer (B), 30.6 parts of sodium acrylate (having a molecular weight of 94) and 13.0 parts of disodium fumarate (having a molecular weight of 160) were used as monomer (C), and the amount of ammonium persulfate was changed to 0.5 part.

REFERENTIAL EXAMPLE 6

A copolymer (6) was obtained by preparing a copolymer having an average molecular weight of 30,000 following the procedure of Referential Example 1, excepting 6.5 parts of phenoxypolyethylene glycol methacrylate (containing an average of 15 ethylene oxide units per molecule and having an average molecular weight of 822) was used as monomer (A), 40.1 parts of monoethanol amine salt of 2-sulfoethyl methacrylate (having a molecular weight of 255) was used as monomer (B), 53.4 parts of methacrylic acid (having an average molecular weight of 86) was used as monomer (C), and the amount of ammonium persulfate was changed to 2.0 parts, and subsequently neutralizing the copolymer with 42.2 parts of an aqueous 25% ammonia water.

REFERENTIAL EXAMPLE 7

A copolymer (7) having an average molecular weight of 70,000 was obtained by following the procedure of Referential Example 1, excepting 10.3 parts of naphthoxypolyethylene glycol acrylate (containing an average of 40 ethylene oxide units per molecule and having an average molecular weight of 1,958) was used as monomer (A), 22.4 parts of ammonium salt of 2-sulfoethyl methacrylate (having a molecular weight of 211) was used as monomer (B), 67.3 parts of potassium methacrylate (having a molecular weight of 124) was used as monomer(C), and the amount of ammonium persulfate was changed to 1.0 part.

REFERENTIAL EXAMPLE 8

A copolymer (8) having an average molecular weight of 20,000 was obtained by following the procedure of Referential Example 1, excepting 9.2 parts of p-methylphenoxypolyethylene glycol methacrylate (containing an average of 10 ethylene oxide units per molecule and having an average molecular weight of 616) was used as monomer (A), 15.5 parts of sodium salt of 2-sulfoethyl methacrylate (having a molecular weight of 216) was used as monomer (B), 75.3 parts of monoethanol amine salt of methacrylic acid (having a molecular weight of 147) was used as monomer (C), and the amount of ammonium persulfate was changed to 2.5 parts.

REFERENTIAL EXAMPLE 9

A copolymer (9) was obtained by preparing a copolymer having an average molecular weight of 60,000 following the procedure of Referential Example 1, excepting 4.7 parts of dimethylphenoxypolyethylene glycol acrylate (containing an average of 20 ethylene oxide units per molecule and having an average molecular weight of 1,056) was used as monomer (A), 61.8 parts of potassium salt of 2-sulfopropyl acrylate (having a molecular weight of 232) was used as monomer (B), 33.5 parts of acrylic acid (having a molecular weight of 72) was used as monomer (C), and the amount of ammonium persulfate was changed to 1.0 part, and subsequently neutralizing the copolymer with 26.1 parts of potassium hydroixde.

REFERENTIAL EXAMPLE 10

In a polymerization vessel fitted with a thermometer, a stirrer, three dropping funnels, a gas inlet tube, and a reflux condenser, 90 parts of water placed therein was stirred and the inner gas of the polymerization vessel was stirred and the inner gas of the polymerization vessel was displaced with nitrogen Then, in an atmosphere of nitrogen the water was heated to 40° C. Subsequently, to the hot water kept at this temperature, a monomer mixture solution containing 6.7 parts of nonylphenoxypolyethylene glycol acrylate (containing an average of 30 ethylene oxide units per molecule and having an average molecular weight of 1,595) as monomer (A), 61.5 parts of diethanol amine salt of 2-sulfoethyl methacrylate (having a molecular weight of 299) as monomer (B), 21.7 parts of methacrylic acid (having a molecular weight of 86) and 10.1 parts of disodium maleate (having a molecular weight of 160) as monomer (C), and 150 parts of water was added dropwise through one of the dropping funnels over a period of 120 minutes. the same time, an aqueous solution containing 0.6 part of ammonium persulfate and 30 parts of water was added dropwise through one of the remaining three dropping funnels over a period of 140 minutes and an aqueous solution containing 0.3 part of sodium hydrogen sulfite and 30 parts of water was added dropwise through the remaining dropping funnel over a period of 140 minutes. After the dropwise addition was completed, polymerization already initiated was continued at the same temperature for 60 minutes and then cooled. Consequently, a copolymer having an average molecular weight of 100,000 was obtained. This copolymer was neutralized with 10.1 parts of sodium hydroxide, to afford a copolymer (10).

REFERENTIAL EXAMPLE 11 copolymer (11) having an average molecular weight of 70,000 was obtained by following the procedure of Referential Example 10, excepting 10.1 parts of octylphenoxypolyethylene glycol-polypropylene glycol acrylate (containing an average of 25 ethylene oxide units and an average of 2 propylene oxide units per molecule and having an average molecular weight of 1,476) was used as monomer (A), 79.5 parts of sodium salt of 2-sulfoethyl acrylate (having a molecular weight of 202) was used as monomer (B), 10.4 parts of diethanol amine salt of methacrylic acid (having a molecular weight of 191) was used as monomer (C), and the amount of ammonium persulfate was changed to 0.8 part and that of sodium hydrogen sulfite to 0.4 part.

REFERENTIAL EXAMPLE 12

A copolymer (12) was obtained by preparing a copolymer having an average molecular weight of 60,000 following the procedure of Referential Example 10, excepting 8.8 parts of dinonylphenoxypolyethylene glycol methacrylate (containing an average of 30 ethylene oxide units per molecule and having an average molecular weight of 1,734) was used as monomer (A), 24.6 parts of 2-sulfoethyl methacrylate (having a molecular weight of 194) was used as monomer (B), 58.2 parts of disodium itaconate (having a molecular weight of 174) was used as monomer (C), 8.4 parts of sodium styrenesulfonate (having a molecular weight of 206) was additionally used as monomer (D), and the amount of ammonium persulfate was changed to 1.0 part and that of sodium hydrogen sulfite to 0.5 part, and subsequently neutralizing the copolymer with 5.1 parts of sodium hydroxide.

REFERENTIAL EXAMPLE 13

A copolymer (13) having an average molecular weight of 150,000 was obtained by following the procedure of Referential Example 10, excepting 5.8 parts of dioctylphenoxypolyethylene glycol acrylate (containing an average of 45 ethylene oxide units per molecule and having an average molecular weight of 2,352) was used as monomer (A), 83.3 parts of sodium salt of 2-sulfoethyl methacrylate (having as molecular weight of 216) was used as monomer (B), 10.9 parts of ammonium methacrylate (having a molecular weight of 103) was used as monomer (C), and the amount of ammonium persulfate was changed to 0.5 part and that of sodium hydrogen sulfite to 0.23 part.

REFERENTIAL EXAMPLE 14

A copolymer (14) having an average molecular weight of 20,000 was obtained by following the procedure of Referential Example 10, excepting 7.8 parts of benzyloxypolyethylene glycol acrylate (containing an average of 12 ethylene oxide units per molecule and having an average molecular weight of 690) was used as monomer (A), 74.6 parts of sodium salt of 2-sulfoethyl acrylate (having a molecular weight of 202) was used as monomer (B), 17.6 parts of sodium acrylate (having a molecular weight of 94) was used as monomer (C), and the amount of ammonium persulfate was changed to 2.5 parts and that of sodium hydrogen sulfite to 1.2 parts.

REFERENTIAL EXAMPLE 15

In the same reaction vessel as used in Referential Example 1, 100 parts of toluene placed therein was stirred and the inner gas of the reaction vessel was displaced with nitrogen. Then, in an atmosphere of nitrogen the toluene was heated to 100° C. Subsequently to the hot toluene kept at this temperature, a monomer mixture solution containing 8.8 parts of isopropoxypolypropylene glycol methacrylate (containing an average of 3 propylene oxide units per molecular and having an average molecular weight of 302) as monomer (A), 53.8 parts of 2-sulfoethyl methacrylate (having a molecular weight of 194) as monomer (B), 31.3 parts of crotonic acid (having a molecular weight of 86) as monomer (C), 6.1 parts of styrene (having a molecular weight of 104) as monomer (D), and 150 parts of toluene was added dropwise through one of the dropping funnels over a period of 120 minutes. At the same time, a mixture containing 3 parts of benzoyl peroxide and 50 parts of toluene was added dropwise through the other dropping funnel over a period of 150 minutes After the dropwise addition was completed, polymerization already initiated was continued at the same temperature for 60 minutes. Then, the polymerization mixture was distilled to expel toluene and obtain a copolymer. This copolymer was dissolved in 300 parts of water and neutralized with 43.6 parts of an aqueous 25% ammonia solution. Consequently, there was obtained a copolymer having an average molecular weight of 10,000.

REFERENTIAL EXAMPLE 16

In the same reaction vessel as used in Referential Example 1, 100 parts of isopropyl alcohol (hereinafter referred to as "IPA") placed therein was stirred and the inner gas of the reaction vessel was displaced with nitrogen. Then in an atmosphere of nitrogen the IPA was heated to the boiling point thereof. Then, to the IPA which was kept refluxed, a monomer mixture solution containing 0.8 part of naphthoxypolyethylene glycol methacrylate (containing an average of 5 ethylene oxide units per molecule and having an average molecular weight of 432) as monomer (A), 84.6 parts of 2-sulfoethyl methacrylate (having a molecular weight of 194) as monomer (B), 14.6 parts of methacrylic acid (having a molecular weight of 86) as monomer (C), and 150 parts of IPA was added dropwise through one of the dropping funnels over a period of 120 minutes At the same time, a mixture containing 0.7 part of azo-bis-isobutyronitrile and 50 parts of IPA was added dropwise through the other dropping funnel over a period of 120 minutes. After the dropwise addition was completed, polymerization already initiated was continued under reflux of IPA for 60 minutes. Then, the polymerization mixture was distilled to expel IPA and obtain a copolymer. The copolymer was dissolved in 300 parts of water and the resulting solution was neutralized with 24.2 parts of sodium hydroxide, to afford a copolymer (16) having an average molecular weight of 130,000.

REFERENTIAL EXAMPLE 17

A control copolymer (1) having an average molecular weight of 40,000 was obtained by following the procedure of Referential Example 1, excepting use of monomer (A) was omitted, 59.6 parts of ammonium slat of 2-sulfoethyl acrylate (having a molecular weight of 197) was used as monomer (B), 40.4 parts of ammonium acrylate (having a molecular weight of 89) was used as monomer (C), and the amount of ammonium persulfate was changed to 1.5 parts.

REFERENTIAL EXAMPLE 18

A control copolymer (2) having an average molecular weight of 150,000 was obtained by following the procedure of Referential Example 1, excepting 0.3 part of methoxypolyethylene glyocl methacrylate (containing an average of 15 ethylene oxide units per molecule and having an average molecular weight of 760) was used as monomer (A), 39.9 parts of sodium salt of 2-sulfoethyl methacrylate (having a molecular weight of 216) was used as monomer (B), 59.8 parts of sodium methacrylate (having a molecular weight of 108) was used as monomer (C), and the amount of ammonium persulfate was changed to 0.5 part.

REFERENTIAL EXAMPLE 19

A control copolymer (3) was obtained by preparing a copolymer having an average molecular weight of 30,000 following the procedure of Referential Example 1, excepting 41.4 parts of phenoxypolyethylene glycol methacrylate (containing an average of 15 ethylene oxide units per molecule and having an average molecular weight of 822) was used as monomer (A), 51.4 parts of monoethanol amine salt of 2-sulfoethyl methacrylate (having a molecular weight of 255) was used as monomer (B), 7.2 parts of methacrylic acid (having a molecular weight of 86) was used as monomer (C), and the amount of ammonium persulfate was changed to 2.0 parts, and subsequently neutralizing the copolymer with 5.7 parts of an aqueous 25% ammonia solution.

REFERENTIAL EXAMPLE 20

A control copolymer (4) having an average molecular weight of 50,000 was obtained by following the procedure of Referential Example 1, excepting 13.1 parts of p-methylphenoxypolyethylene glycol methacrylate (containing an average of 10 ethylene oxide units per molecule and having an average molecular weight of 616) was used as monomer (A), 1.9 parts of sodium salt of 2-sulfoethyl methacrylate (having a molecular weight of 216) was used as monomer (B), 85.0 parts of ammonium methacrylate (having a molecular weight of 103) was used as monomer (C), and the amount of ammonium persulfate was changed to 2.0 parts.

REFERENTIAL EXAMPLE 21

A control copolymer (5) having an average molecular weight of 150,000 was obtained by following the procedure of Referential Example 1, excepting 19.9 parts of ethoxypolyethylene glycol acrylate (containing an average of 45 ethylene oxide units per molecule and having an average molecular weight of 2,080) was used as monomer (A), 79.7 parts of sodium salt of 2-sulfoethyl methacrylate (having a molecular weight of 216) was used as monomer (B), 0.11 part of sodium methacrylate (having a molecular weight of 108) was used as monomer (C), and the amount of ammonium persulfate was changed to 0.5 part.

REFERENTIAL EXAMPLE 22

A control copolymer (6) having an average molecular weight of 30,000 was obtained by following the procedure of Referential Example 1, excepting use of monomer (A) was omitted, and 58.7 parts of ammonium salt of 2-sulfoethyl acrylate (having a molecular weight of 197) as monomer (B), 40.3 parts of ammonium acrylate (having a molecular weight of 89) as monomer (C), and 1.0 part of polyethylene glycol monomethacrylate (containing an average of 3 ethylene oxide units per molecule and having an average molecular weight of 218) as monomer (D) were used, and the amount of ammonium persulfate was changed to 2.0 parts.

Table 1 shows the compositions (molar ratios) of the monomers (A), (B), (C), and (D) used in Referential Examples 1-22 and the average molecular weights of the copolymers (1) through (16) and the control copolymers (1) through (6) obtained respectively therein.

The average molecular weights of the copolymers were determined by the GPC method using polyethylene glycol as the standard.

TABLE 1

| Referential Example | Copolymer obtained | Monomer composition (mol %) (A)/(B)/(C)/(D) | Average molecular weight |
|---|---|---|---|
| 1 | (1) | 0.5/69/30.5/0 | 60,000 |
| 2 | (2) | 1/39/60/0 | 40,000 |
| 3 | (3) | 0.5/85/14.5/0 | 200,000 |
| 4 | (4) | 0.8/50/47.2/2 | 60,000 |
| 5 | (5) | 0.2/39.8/60/0 | 150,000 |
| 6 | (6) | 1/2/79/0 | 30,000 |
| 7 | (7) | 0.8/16.2/83/0 | 70,000 |
| 8 | (8) | 2.5/12/85.5/0 | 20,000 |
| 9 | (9) | 0.6/36.2/63.2/0 | 60,000 |
| 10 | (10) | 0.8/39.2/60/0 | 100,000 |
| 11 | (11) | 1.5/86.5/12/0 | 70,000 |
| 12 | (12) | 1/25/66/8 | 60,000 |
| 13 | (13) | 0.5/78/21.5/0 | 150,000 |
| 14 | (14) | 2/65/33/0 | 20,000 |
| 15 | (15) | 4/38/50/8 | 10,000 |
| 16 | (16) | 0.3/71.7/28/0 | 130,000 |
| | Control Colpolymer | | |
| 17 | (1) | 0/40/60/0 | 40,000 |
| 18 | (2) | 0.05/25/74.95/0 | 150,000 |
| 19 | (3) | 15/60/25/0 | 30,000 |
| 20 | (4) | 2.5/1/96.5/0 | 50,000 |
| 21 | (5) | 2.5/96.5/1/0 | 150,000 |
| 22 | (6) | 0/39.4/60/0.6 | 30,000 |

EXAMPLES 1-16 AND CONTROLS 1-8

An aqueous coal slurry was prepared by the following procedure using each of the copolymers (1) through (16) obtained in Referential Examples 1-16, as a dispersant. This aqueous coal slurry was tested for viscosity.

In a ball mill having an inner volume of 6 liters and containing balls at a loading ratio of 30%, an aqueous solution containing a given copolymer and coal A (possessing the quality shown in Table 2) coarsely crushed into grains about 2 mm in diameter was placed in an amount prescribed to give 2,000 g of a finished slurry and subjected therein to wet pulverization to prepare an aqueous coal slurry containing coal particles of diameters such that 83±3% of all the particles passed a 200-mesh sieve (not more than 74 μm).

The aqueous coal slurry thus obtained was tested for viscosity with a Brookfield type viscometer (rotor No. 6, 50 rpm) at 25° C.

The amount of the dispersant added, the concentration of coal, and the viscosity of the produced aqueous coal slurry were as shown in Table 3.

For this slurry, the decreasing viscosity is a criterion of the increasing flowability.

For comparison, the control copolymers (1) through (6) obtained respectively in Referential Examples 17 through 22, sodium polyacrylate (having an average molecular weight of 20,000), and a formaline condensate of nonylphenolethylene oxide adduct (having an average condensation degree of 4, containing an average of 100 ethylene oxide units per molecule of nonylphenol, and having an average molecular weight of 20,000) were similarly used by the procedure described above. The results are also shown as those of Controls 1-8 in Table 3.

EXAMPLES 17-32 AND CONTROLS 9-16

Aqueous coal slurries were prepared by faithfully repeating the procedures of Examples 1-16 and Controls 1-8, excepting coal B (possessing the quality shown in Table 2) was used instead. The aqueous coal slurries were tested for viscosity.

The amount of the dispersant added, the concentration of coal, and the viscosity of the produced aqueous coal slurry were as shown in Table 3.

EXAMPLES 33-48 AND CONTROLS 17-24

Aqueous coal slurries were prepared by faithfully repeating the procedures of Examples 1-16 and Controls 1-8, excepting coal C (possessing the quality shown in Table 2) was used instead. The aqueous coal slurries were tested for viscosity.

The amount of the dispersant added, the concentration of coal, and the viscosity of the produced aqueous coal slurry were as shown in Table 3.

TABLE 2

| Item | Base of indication | Coal A | Coal B | Coal C |
|---|---|---|---|---|
| High-order calorific value (Kcal/Kg) | Constant Wet base | 6,900 | 7,900 | 7,400 |
| Moisture content (%) | " | 3.2 | 4.5 | 1.5 |
| Ash content (%) | " | 12.6 | 0.7 | 14.0 |
| Volatile content (%) | " | 30.8 | 35.8 | 37.8 |
| Fixed carbon (%) | " | 53.4 | 59.0 | 46.7 |
| Fuel ratio | — | 1.73 | 1.65 | 1.24 |
| (Elementary analysis) | | | | |
| Ash content (%) | Anhydrous base | 13.0 | 0.7 | 14.2 |
| Carbon (%) | " | 74.6 | 81.0 | 70.9 |
| Hydrogen (%) | " | 4.6 | 4.9 | 5.2 |
| Oxygen (%) | " | 5.5 | 11.4 | 5.8 |
| (Ash composition) | | | | |
| $SiO_2$ (%) | Anhydrous base | 76.6 | 64.1 | 39.3 |
| $Al_2O_3$ (%) | " | 15.2 | 18.5 | 21.5 |
| CaO (%) | " | 0.9 | 2.2 | 14.3 |
| MgO (%) | " | 0.4 | 1.9 | 0.9 |
| $Na_2O$ (%) | " | 0.3 | 1.6 | 3.3 |
| $K_2O$ (%) | " | 0.7 | 0.5 | 0.5 |
| $Fe_2O_3$ (%) | " | 3.0 | 7.5 | 8.8 |

TABLE 3

| Example | Dispersant used | Coal used | Amount of dispersant used (% by weight, based on slurry) | Concentration of coal (% by weight, based on slurry) | Viscosity of slurry (cps) |
|---|---|---|---|---|---|
| 1 | copolymer (1) | Coal A | 0.3 | 68.0 | 1,500 |
| 2 | " (2) | " | 0.3 | 68.0 | 1,600 |
| 3 | " (3) | " | 0.4 | 66.0 | 1,600 |

TABLE 3-continued

| Example | Dispersant used | | Coal used | Amount of dispersant used (% by weight, based on slurry) | Concentration of coal (% by weight, based on slurry) | Viscosity of slurry (cps) |
|---|---|---|---|---|---|---|
| 4 | " | (4) | " | 0.3 | 68.0 | 1,400 |
| 5 | " | (5) | " | 0.5 | 67.0 | 1,700 |
| 6 | " | (6) | " | 0.3 | 69.0 | 1,400 |
| 7 | " | (7) | " | 0.4 | 68.0 | 1,600 |
| 8 | " | (8) | " | 0.5 | 68.0 | 1,500 |
| 9 | " | (9) | " | 0.4 | 69.0 | 1,600 |
| 10 | " | (10) | " | 0.5 | 67.0 | 1,400 |
| 11 | " | (11) | " | 0.5 | 68.0 | 1,500 |
| 12 | " | (12) | " | 0.5 | 67.0 | 1,700 |
| 13 | " | (13) | " | 0.4 | 68.0 | 1,400 |
| 14 | " | (14) | " | 0.3 | 69.0 | 1,700 |
| 15 | " | (15) | " | 0.4 | 67.0 | 1,800 |
| 16 | " | (16) | " | 0.3 | 68.0 | 1,600 |
| Control | | | | | | |
| 1 | Control copolymer | (1) | Coal A | 0.7 | 66.0 | >10,000 |
| 2 | " | (2) | " | 0.7 | 66.0 | >10,000 |
| 3 | " | (3) | " | 0.7 | 66.0 | >10,000 |
| 4 | " | (4) | " | 0.5 | 66.0 | 3,000 |
| 5 | " | (5) | " | 0.5 | 66.0 | 2,500 |
| 6 | " | (6) | " | 0.5 | 66.0 | 2,800 |
| 7 | (Note 1) | | " | 1.0 | 62.0 | >10,000 |
| 8 | (Note 2) | | " | 0.6 | 66.0 | >10,000 |
| 17 | copolymer | (1) | Coal B | 0.3 | 68.0 | 1,500 |
| 18 | " | (2) | " | 0.3 | 69.0 | 1,600 |
| 19 | " | (3) | " | 0.4 | 68.0 | 1,800 |
| 20 | " | (4) | " | 0.3 | 68.0 | 1,400 |
| 21 | " | (5) | " | 0.4 | 69.0 | 1,700 |
| 22 | " | (6) | " | 0.4 | 71.0 | 1,600 |
| 23 | " | (7) | " | 0.4 | 70.0 | 1,500 |
| 24 | " | (8) | " | 0.5 | 71.0 | 1,600 |
| 25 | " | (9) | " | 0.4 | 70.0 | 1,800 |
| 26 | " | (10) | " | 0.5 | 68.0 | 1,600 |
| 27 | " | (11) | " | 0.5 | 68.0 | 1,800 |
| 28 | " | (12) | " | 0.4 | 68.0 | 1,600 |
| 29 | " | (13) | " | 0.4 | 67.0 | 1,500 |
| 30 | " | (14) | " | 0.3 | 69.0 | 1,700 |
| 31 | " | (15) | " | 0.4 | 68.0 | 1,700 |
| 32 | " | (16) | " | 0.3 | 68.0 | 1,500 |
| Control | | | | | | |
| 9 | Control copolymer | (1) | Coal B | 0.7 | 67.0 | >10,000 |
| 10 | " | (2) | " | 0.7 | 67.0 | >10,000 |
| 11 | " | (3) | " | 0.7 | 67.0 | >10,000 |
| 12 | " | (4) | " | 0.5 | 67.0 | 2,500 |
| 13 | " | (5) | " | 0.5 | 67.0 | >10,000 |
| 14 | " | (6) | " | 0.5 | 67.0 | 3,000 |
| 15 | (Note 1) | | " | 1.0 | 62.0 | >10,000 |
| 16 | (Note 2) | | " | 0.7 | 67.0 | >10,000 |
| 33 | copolymer | (1) | Coal C | 0.3 | 69.0 | 1,600 |
| 34 | " | (2) | " | 0.4 | 70.0 | 1,600 |
| 35 | " | (3) | " | 0.5 | 70.0 | 1,500 |
| 36 | " | (4) | " | 0.3 | 69.0 | 1,800 |
| 37 | " | (5) | " | 0.4 | 69.0 | 1,600 |
| 38 | " | (6) | " | 0.5 | 70.0 | 1,800 |
| 39 | " | (7) | " | 0.4 | 69.0 | 1,600 |
| 40 | " | (8) | " | 0.5 | 69.0 | 1,800 |
| 41 | " | (9) | " | 0.4 | 70.0 | 1,900 |
| 42 | " | (10) | " | 0.5 | 69.0 | 1,600 |
| 43 | " | (11) | " | 0.5 | 71.0 | 1,700 |
| 44 | " | (12) | " | 0.4 | 69.0 | 1,500 |
| 45 | " | (13) | " | 0.3 | 71.0 | 1,800 |
| 46 | " | (14) | " | 0.3 | 70.0 | 1,500 |
| 47 | " | (15) | " | 0.4 | 70.0 | 1,800 |
| 48 | " | (16) | " | 0.4 | 71.0 | 1,600 |
| Control | | | | | | |
| 17 | Control copolymer | (1) | Coal C | 0.7 | 69.0 | >10,000 |
| 18 | " | (2) | " | 0.7 | 69.0 | >10,000 |
| 19 | " | (3) | " | 0.7 | 69.0 | >10,000 |
| 20 | " | (4) | " | 0.7 | 66.0 | >10.000 |
| 21 | " | (5) | " | 0.5 | 68.0 | 2,400 |
| 22 | " | (6) | " | 0.5 | 69.0 | >10,000 |
| 23 | (Note 1) | | " | 1.0 | 62.0 | >10,000 |

TABLE 3-continued

| Example | Dispersant used | Coal used | Amount of dispersant used (% by weight, based on slurry) | Concentration of coal (% by weight, based on slurry) | Viscosity of slurry (cps) |
|---|---|---|---|---|---|
| 24 | (Note 2) | " | 0.7 | 68.0 | >10,000 |

(Note 1) Sodium salt of polyacrylic acid (having an average molecular weight of 20,000)
(Note 2) Formalin condensate of nonylphenol-ethylene oxide adduct (having an average condensation degree of 4, containing an average of 100 ethylene oxide units per molecule, and having an average molecular weight of 20,000).

EXAMPLE 49–55

A portion, 300 g of each of the aqueous coal slurry using coal A in Examples 1, 5, 6, 8, 10, 14, and 16 was diluted with water to a viscosity of 10±1 poises. The sample thus prepared was placed and left standing in a cylindrical tank 1 designed as illustrated in FIG. 1. At intervals along the course of time, slurry portions, about 1 g each, were taken from the upper and lower layers of the sample respectively through outlets 2 and 3 and analyzed for coal concentration, to determine the condition of sedimentation of the aqueous coal slurry and evaluate the stability of the slurry in standing. In FIG. 1, the reference numeral 4 denotes the aqueous coal slurry and the dimensional figures are given by the denomination of mm.

The concentration of coal in the viscosity adjusted aqueous coal slurry before standing in the tank, the kind of dispersant, the amount of dispersant added, and the stability of the slurry standing in the tank were as shown in Table 4. The stability of a given sample of aqueous coal slurry in standing was determined by finding the duration of stability of this sample, namely the period of standing in which the difference of concentration between the two specimens taken simultaneously from the upper and lower layers of the sample was within 2% by weight, and rating this duration of stability on a four-point scale, wherein A stands for a period of not less than 2 months, B for a period of not less than 1 month and less than 2 months, C for a period of not less than 1 week and less than 1 month, and D for a period of less than 1 week.

EXAMPLES 56–85

The aqueous coal slurries which were found to be deficient in stability in standing (rated as B, C, or D) based on the results obtained in Examples 49–55 were property supplemented with the stabilizing agent and/or the dispersion aid an then tested for stability in standing by the following procedure.

A sample, 300 g, taken from each of the aqueous coal slurries obtained by following the procedure of Examples 6, 8, and 10 and a stabilizing agent and/or a dispersion aid and diluting water added thereto in amounts indicated in Table 4 were stirred in a homo mixer (produced by Tokushukiko Kogyo K. K. and marketed under trademark designation of "T. K. Autohomomixer, Type M) at a rate of 5,000 rpm for 5 minutes. Consequently, there was produced an aqueous coal slurry having a viscosity of 10±1 poises and intended for test for stability in standing. The aqueous coal slurries consequently obtained were each tested for stability in standing by the procedure of Example 49.

The concentration of coal in the aqueous coal slurry before standing in the tank, the kind of dispersant, the amount of dispersant added, the kind of stabilizing agent additionally used, the amount of stabilizing agent added, the kind of dispersion aid additionally used, the amount of dispersion aid added, and the stability of the slurry in standing were as shown in Table 4.

TABLE 4

| | Coal | | Stabilizer | | Dispersion aid | | Stabilizer | | |
|---|---|---|---|---|---|---|---|---|---|
| Example | Kind | Concentration (% by weight, based on slurry) | Kind | Amount added (% by weight, based on slurry) | Kind | Amount added (% by weight, based on slurry) | Kind | Amount added (% by weight, based on slurry) | Stability in standing (1) |
| 49 | Coal A | 67.2 | (1) | 0.3 | none | 0 | none | 0 | A |
| 50 | " | 66.0 | (5) | 0.5 | none | 0 | none | 0 | A |
| 51 | " | 68.3 | (6) | 0.3 | none | 0 | none | 0 | C |
| 52 | " | 67.2 | (8) | 0.5 | none | 0 | none | 0 | C |
| 53 | " | 66.3 | (10) | 0.5 | none | 0 | none | 0 | B |
| 54 | " | 68.0 | (14) | 0.3 | none | 0 | none | 0 | A |
| 55 | " | 67.1 | (16) | 0.3 | none | 0 | none | 0 | A |
| 56 | " | 68.0 | (6) | 0.3 | CMC (Note 2) | 0.002 | none | 0 | B |
| 57 | " | 67.9 | (6) | 0.3 | CMC (Note 2) | 0.005 | none | 0 | A |
| 58 | " | 66.8 | (8) | 0.5 | xanthane gum | 0.001 | none | 0 | A |
| 59 | " | 66.8 | (8) | 0.5 | none | 0 | (Note 3) | 0.05 | A |
| 60 | " | 66.7 | (8) | 0.5 | hydroxyethyl cellulose | 0.005 | (Note 4) | 0.1 | A |
| 61 | " | 66.8 | (8) | 0.5 | Polysodium acrylate (Note 5) | 0.02 | none | 0 | A |
| 62 | Coal A | 66.0 | (10) | 0.5 | bentonite | 0.1 | none | 0 | A |
| 63 | " | 66.5 | (8) | 0.5 | montmorilonite | 0.1 | none | 0 | A |
| 64 | " | 66.9 | (8) | 0.5 | hydroxyethyl cellulose | 0.01 | none | 0 | A |
| 65 | " | 66.9 | (8) | 0.5 | CMC | 0.010 | none | 0 | A |
| 66 | " | 66.0 | (8) | 0.5 | attapulgite | 0.1 | none | 0 | A |
| 67 | " | 66.9 | (8) | 0.5 | none | 0 | (Note 6) | 0.1 | A |
| 68 | " | 66.9 | (8) | 0.5 | none | 0 | (Note 7) | 0.1 | A |

TABLE 4-continued

| Example | Coal Kind | Coal Concentration (% by weight, based on slurry) | Stabilizer Kind | Stabilizer Amount added (% by weight, based on slurry) | Dispersion aid Kind | Dispersion aid Amount added (% by weight, based on slurry) | Stabilizer Kind | Stabilizer Amount added (% by weight, based on slurry) | Stability in standing (1) |
|---|---|---|---|---|---|---|---|---|---|
| 69 | " | 67.0 | (8) | 0.5 | none | 0 | (Note 8) | 0.05 | A |
| 70 | " | 66.7 | (8) | 0.5 | CMC (Note 2) | 0.005 | (Note 3) | 0.02 | A |
| 71 | " | 66.5 | (8) | 0.5 | CMC (Note 2) | 0.005 | (Note 6) | 0.05 | A |
| 72 | " | 66.5 | (8) | 0.5 | CMC (Note 2) | 0.005 | (Note 7) | 0.05 | A |
| 73 | " | 66.7 | (8) | 0.5 | CMC (Note 2) | 0.005 | (Note 8) | 0.02 | A |
| 74 | " | 66.7 | (8) | 0.5 | xanthane gum | 0.005 | (Note 3) | 0.02 | A |
| 75 | " | 66.5 | (8) | 0.5 | xanthane gum | 0.005 | (Note 6) | 0.05 | A |
| 76 | Coal A | 66.5 | (8) | 0.5 | xanthane gum | 0.005 | (Note 7) | 0.05 | A |
| 77 | " | 66.7 | (8) | 0.5 | xanthane gum | 0.005 | (Note 8) | 0.02 | A |
| 78 | " | 66.7 | (8) | 0.5 | montmorillonite | 0.05 | (Note 3) | 0.02 | A |
| 79 | " | 66.5 | (8) | 0.5 | montmorillonite | 0.08 | (Note 6) | 0.05 | A |
| 80 | " | 66.5 | (8) | 0.5 | montmorillonite | 0.08 | (Note 7) | 0.05 | A |
| 81 | " | 66.7 | (8) | 0.5 | montmorillonite | 0.05 | (Note 8) | 0.02 | A |
| 82 | " | 66.7 | (8) | 0.5 | polysodium acrylate (Note 5) | 0.01 | (Note 3) | 0.02 | A |
| 83 | " | 66.5 | (8) | 0.5 | polysodium acrylate (Note 5) | 0.01 | (Note 6) | 0.05 | A |
| 84 | " | 66.5 | (8) | 0.5 | polysodium acrylate (Note 5) | 0.01 | (Note 7) | 0.05 | A |
| 85 | " | 66.7 | (8) | 0.5 | polysodium acrylate (Note 5) | 0.01 | (Note 8) | 0.02 | A |

(Note 1) A for period of not less than 2 months, B for a period of stability of not less than 1 month and not less than 2 month, C for a period of stability of not less than 1 week and less than 1 month, and d for a period of stability of less than 1 week.
(Note 2) Sodium salt of carboxymethyl cellulose (having an etherification degree of 0.90).
(Note 3) Formalin condensate of nonylphenyl-ethylene oxide adduct (having an average condensation degree of 10, containing an average of 50 ethylene oxide units per molecule of nonylphenol, and having an average molecular weight of 25,000).
(Note 4) Polysodium sulfonate (having an average moleuclar weight of 10,000).
(Note 5) Polysodium acrylate (having an average molecular weight of 500,000).
(Note 6) Formalin condensate of sodium naphthalene sulfonate (having 8 of condensation degree).
(Note 7) Polymerizate of dicyclopentadiene sulfonate (having an average molecular weight of 10,000)
(Note 8) Styrene-sodium styrene sulfonate copolymer (having molar ratio of 0.4/0.6 and an average molecualr weight of 10,000).

EXAMPLES 86–100

A portion, 300 g, of each of the aqueous coal slurries obtained using coal B in Examples 17, 21, 22, 24, 26, 30, and 32 and a stabilizing agent and/or a dispersion aid and diluting water added thereto in amounts indicated in Table 5 were stirred at a rate of 5,000 rpm for five minutes in a homomixer (produced by Tokushukika Kogyo K. K. and marketed under trademark designation of "T. K." utohomomixer, Type M), to produce an aqueous coal slurry having a viscosity of 10±1 poises and intended for test for stability in standing.

The aqueous coal slurries thus obtained were each tested for stability in standing by the procedure of Example 49.

The concentration of coal in the aqueous coal slurry before standing in the tank the kind of dispersant, the amount of dispersant added, the kind of stabilizing agent additionally used, the amount of stabilizing agent added, the kind of dispersion aid additionally used, the amount of dispersion aid added, and the stability of the slurry in standing were as shown in Table 5.

EXAMPLE 101–104

A portion, 300 g, of each of the aqueous coal slurries obtained using coal C in Examples 38 and 40 a stabilizing agent and/or a dispersion aid and diluting water added thereto in amounts indicated in Table 5 were stirred at a rate of 5,000 rpm for five minutes in a homomixer (produced by Tokushukika Kogyo K. K. and marketed under trademark designation of "T. K." utohomomixer, Type M), to produce an aqueous coal slurry having a viscosity of 10±1 poises and intended for test for stability in standing.

The aqueous coal slurries thus obtained were each tested for stability in standing by the procedure of Example 49.

The concentration of coal in the aqueous coal slurry before standing in the tank, the kind of dispersant, the amount of dispersant added, the kind of stabilizing agent additionally used, the amount of stabilizing agent added, the kind of dispersion aid additionally used, the amount of dispersion aid added, and the stability of the slurry in standing were as shown in Table 5.

TABLE 5

| Example | Coal Kind | Coal Concentration (% by weight, based on slurry) | Stabilizer Kind | Stabilizer Amount added (% by weight, based on slurry) | Dispersion aid Kind | Dispersion aid Amount added (% by weight, based on slurry) | Stabilizer Kind | Stabilizer Amount added (% by weight, based on slurry) | Stability in standing (1) |
|---|---|---|---|---|---|---|---|---|---|
| 86 | Coal B | 67.0 | (1) | 0.3 | CMC (Note 2) | 0.003 | none | 0 | B |
| 87 | " | 66.7 | (1) | 0.3 | CMC (Note 2) | 0.01 | none | 0 | A |
| 88 | " | 66.9 | (1) | 0.3 | xanthane gum | 0.02 | none | 0 | B |
| 89 | " | 67.0 | (1) | 0.3 | none | 0 | (Note 3) | 0.05 | C |
| 90 | " | 66.8 | (1) | 0.3 | none | 0 | (Note 3) | 0.1 | B |
| 91 | " | 68.3 | (5) | 0.4 | none | 0 | (Note 4) | 0.1 | C |
| 92 | " | 67.8 | (5) | 0.4 | palygorskite | 0.3 | (Note 4) | 0.1 | A |
| 93 | " | 69.8 | (6) | 0.4 | bentonite | 0.2 | none | 0 | A |

TABLE 5-continued

| Example | Coal Kind | Coal Concentration (% by weight, based on slurry) | Stabilizer Kind | Stabilizer Amount added (% by weight, based on slurry) | Dispersion aid Kind | Dispersion aid Amount added (% by weight, based on slurry) | Stabilizer Kind | Stabilizer Amount added (% by weight, based on slurry) | Stability in standing (1) |
|---|---|---|---|---|---|---|---|---|---|
| 94 | " | 69.8 | (6) | 0.4 | attapulgite | 0.2 | none | 0 | A |
| 95 | " | 69.8 | (6) | 0.4 | montmorillonite | 0.2 | none | 0 | A |
| 96 | " | 69.6 | (8) | 0.5 | bentonite | 0.1 | (Note 3) | 0.1 | A |
| 97 | " | 66.6 | (10) | 0.5 | none | 0 | (Note 3) | 0.1 | A |
| 98 | " | 67.8 | (14) | 0.3 | xanthane gum | 0.01 | none | 0 | B |
| 99 | " | 67.7 | (14) | 0.3 | xanthane gum | 0.03 | none | 0 | A |
| 100 | " | 66.8 | (16) | 0.3 | CMC (Note 2) | 0.008 | none | 0 | A |
| 101 | Coal C | 68.5 | (6) | 0.5 | none | 0 | (Note 5) | 0.1 | A |
| 102 | " | 67.5 | (8) | 0.5 | none | 0 | (Note 6) | 0.1 | A |
| 103 | " | 68.6 | (8) | 0.5 | none | 0 | (Note 7) | 0.1 | A |
| 104 | " | 67.3 | (8) | 0.5 | hydroxyethyl cellulose | 0.005 | none | 0 | A |

(Note 1) A for period of not less than 2 months, B for a period of stability of not less than 1 month and not less than 2 months, C for a period of stability of not less than 1 week and less than 1 month, and D for a period of stability of less than 1 week.
(Note 2) Sodium salt of carboxymethyl cellulose (having an etherification degree of 0.90).
(Note 3) Formalin condensate of nonylphenol-propylene oxide-ethylene oxide adduct (having an average condensation degree of 8, containing an average of 10 propylene oxide units and an average of 40 ethylene oxide units per molecule of nonylphenol, and having an average molecular weight of 10,000).
(Note 4) Polysodium sulfonate (having an average molecular weight of 10,000).
(Note 5) Formalin condensate of sodium naphthalenesulfonate (having a consensation degree of 8).
(Note 6) Polymer of sulfonate of dicyclopentadiene (having an average molecular weight of 10,000).
(Note 7) Styrene-sodium styrenesulfonate copolymer (molar ratio 0.4/0.6, having an average molecular weight of 10,000).

EXAMPLES 105–108

Aqueous coal slurries were prepared by following the procedure of Example 1, excepting coal D (having the quality shown in Table 6) coarsely crushed into particles about 2 mm in diameter and aqueous solutions of the copolymers (2), (5), (7), and (14) added thereto as dispersant in amounts calculated to give 2,000 g of finished slurry were severally mixed in the same ball mill as used in Example 1. These aqueous coal slurries were tested for viscosity by following the procedure of Example 1 to determine their flowability. They were also tested for pH.

The concentration of coal in the aqueous coal slurry, the kind of dispersant used, the amount of dispersant added, and the pH value and viscosity of the slurry were as shown in Table 7.

EXAMPLES 109–115

Aqueous coal slurries were prepared by following the procedure of Example 1, excepting coal D (having the quality shown in Table 6) coarsely crushed into particles about 2 mm in diameter and aqueous solutions containing dispersants and pH adjusting agents as shown in Table 7 and added thereto in amounts calculated to give 2,000 g of finished slurry were severally mixed in the same ball mill as used in Example 1. These aqueous coal slurries were tested for viscosity by following the procedure of Example 1 to determine their flowability. They were also tested for pH.

The concentration of coal in the aqueous coal slurry, the kind of dispersant used, the amount of dispersant added, the kind of pH adjusting agent, the amount of pH adjusting agent added, and the pH value and viscosity of the aqueous coal slurry obtained were as shown in Table 7.

TABLE 2

| Item | Base of indication | Analysis Coal D |
|---|---|---|
| High-order calorific value (Kcal/Kg) | constant wet base | 6,700 |
| Moisture content (%) | " | 3.4 |
| Ash Content (%) | " | 13.1 |
| Volatile content (%) | " | 26.1 |
| Fixed carbon (%) | " | 57.4 |
| Fuel ratio | — | 2.20 |
| (Elementary analysis) | | |
| Ash Content (%) | Anhydrous abse | 13.6 |
| Carbon (%) | " | 74.1 |
| Hydrogen (%) | " | 4.4 |
| Oxygen (%) | " | 7.9 |
| (Ash composition) | | |
| $SiO_2$ (%) | Anhydrous base | 51.8 |
| $Al_2O_3$ (%) | " | 35.6 |
| CaO (%) | " | 2.0 |
| MgO (%) | " | 0.6 |
| $Na_2O$ (%) | " | 0.4 |
| $Fe_2O_3$ (%) | " | 4.8 |

TABLE 7

| Example | Concentration of coal (% by weight, based on slurry) | Stabilizer Kind | Stabilizer Amount added (% by weight, based on slurry) | pH adjusting agent Kind | pH adjusting agent Amount added (% by weight, based on slurry) | Viscosity pH of slurry | of slurry (cps) |
|---|---|---|---|---|---|---|---|
| 105 | 67.0 | Copolymer (2) | 0.5 | none | 0 | 5.7 | 1,600 |
| 106 | 67.5 | " (5) | 0.5 | none | 0 | 5.6 | 1,900 |
| 107 | 67.0 | " (7) | 0.5 | none | 0 | 5.5 | 1,200 |
| 108 | 67.5 | " (14) | 0.5 | none | 0 | 5.7 | 1,800 |
| 109 | 67.0 | " (2) | 0.5 | ammonia | 0.15 | 8.0 | 1,000 |
| 110 | 67.5 | " (5) | 0.5 | sodium hydroixde | 0.05 | 7.0 | 1,600 |
| 111 | 67.5 | " (5) | 0.5 | " | 0.15 | 8.9 | 1,000 |
| 112 | 67.0 | " (7) | 0.5 | monoethanol amine | 0.4 | 7.6 | 900 |

TABLE 7-continued

| Example | Concentration of coal (% by weight, based on slurry) | Stabilizer Kind | | Amount added (% by weight, based on slurry) | pH adjusting agent Kind | Amount added (% by weight, based on slurry) | Viscosity pH of slurry | of slurry (cps) |
|---|---|---|---|---|---|---|---|---|
| 113 | 67.5 | " | (14) | 0.5 | magnesium hydroixde | 0.15 | 7.8 | 1,300 |
| 114 | 67.5 | " | (14) | 0.5 | calcium hydroixde | 0.10 | 8.0 | 1,300 |
| 115 | 67.5 | " | (5) | 0.5 | potassium hydroxide | 0.10 | 8.0 | 1,300 |

INDUSTRIAL APPLICABILITY

The dispersant for an aqueous carbonaceous solid slurry according with the present invention excels in ability to effect dispersion of a carbonaceous solid, particularly coal, in water. By the addition of this dispersant only in a small amount, there can be produced an aqueous carbonaceous solid slurry of high flowability in a highly concentrated form.

Conveyance of a given carbonaceous solid via a pipeline can be accomplished with high economy by converting this carbonaceous solid into an aqueous slurry by the use of the dispersant of this invention. Thus, the present invention offers a solution to the problem encountered in the transportation and combustion of carbonaceous solids.

The dispersant of the present invention for an aqueous carbonaceous solid slurry, therefore, contributes immensely to the dissemination of techniques for utility of carbonaceous solids as by direct combustion and gasification.

Particularly the dispersant of this invention manifests its outstanding ability to effect uniform dispersion of a carbonaceous solid without reference to the ash content, the water content, and the chemical composition thereof. Thus, it can be used advantageously invariably for dispersion of coal of any species in water.

The dispersant of this invention can be used, without any sacrifice of its performance, in combination with a hydrophilic polymer, a surfactant, or an inorganic powder as a dispersion aid or a stabilizing agent. It, therefore, permits easy production of an aqueous carbonaceous solid slurry composition which enjoys not only a high solid content and high flowability but also outstanding stability to withstand the effect of aging.

What is claimed is:

1. A dispersant for an aqueous carbonaceous solid slurry, comprising a water-soluble copolymer having an average molecular weight of 1,000 to 500,000 and obtained by polymerizing the following monomer components (A), (B), (C), and (D) and/or a water-soluble copolymer obtained by neutralizing said copolymer with a basic substance:

(A) 0.1 to 7 mol % of a polyalkylene glycol mono(-meth)acrylate type monomer represented by the general formula I:

$$CH_2{=}\overset{\overset{\displaystyle R^1}{|}}{C}{-}COO{-}(R^2O)_n{-}R^3 \qquad (I)$$

wherein $R^1$ stands for hydrogen atom or methyl group, $R^2$ for alkylene group having 2 to 4 carbon atoms, n for a numeral in the range of 1 to 100 on the average, and $R^3$ for an alkyl, alkenyl, or aryl group having 1 to 30 carbon atoms, an alkyl, cyclic alkyl, or cyclic alkenyl group possessing an aryl group as a substituent, or a monovalent organic group derived from a heterocyclic compound, (B) 5 to 94.9 mol % of a sulfoalkyl (meth)acrylate type monomer represented by the general formula II:

$$CH_2{=}\overset{\overset{\displaystyle R^4}{|}}{C}{-}COOR^5SO_3X \qquad (II)$$

wherein $R^4$ stands for hydrogen atom or methyl group, $R^5$ for an alkylene group having 1 to 4 carbon atoms and X for hydrogen atom, an alkali metal atom, an alkaline earth metal atom, an ammonium group, or an amine base, (C) 5 to 94.9 mol % of an unsaturated carboxylic acid type monomer represented by the general formula III:

$$\underset{\underset{\displaystyle R^7}{|}}{\overset{\overset{\displaystyle R^6}{|}}{C}}{=}\overset{\overset{\displaystyle R^8}{|}}{C}{-}COOY \qquad (III)$$

wherein $R^6$ and $R^7$ independently stand for hydrogen atom, methyl group, or —COOY, providing that $R^6$ and $R^7$ do not simultaneously stand for —COOY, $R^8$ stands for hydrogen atom, methyl group, —COOY, or —$CH_2$COOY, providing that $R^6$ and $R^7$ independently stand for hydrogen atom or methyl group where $R^8$ stands for —COOY or —$CH_2$COOY, and Y stands for hydrogen atom, alkali metal atom, alkaline earth metal atom, ammonium group, or amine base, and (D) 0 to 20 mol % of other monomer providing that the total amount of said monomer component (A), (B), (C), and (D) is 100 mol %.

2. The dispersant of claim 1, wherein said water-soluble copolymer obtained by the polymerization of said monomer components has an average molecular weight in the range of 5,000 to 300,000.

3. The dispersant of claim 1, wherein said unsaturated carboxylic acid type monomer (C) is at least one member selected from the group consisting of maleic acid and (meth)acrylic acid and alkali metal salts, alkaline earth metal salts, ammonium salts, and amine salts of said acids.

4. The dispersant of claim 1, wherein said unsaturated carboxylic acid type monomer (C) is at least one member selected from the group consisting of maleic acid and (meth)acrylic acid and sodium salts, potassium salts, ammonium salts, and alkanolamine salts of said acids.

5. The dispersant of claim 4, wherein said alkanolamine salts of maleic acid and (meth)acrylic acid are monoethanolamine salts, diethanolamine salts, or triethanolamine salts.

6. The dispersant of claim 1, wherein $R^1$ stands for hydrogen atom or methyl group, $R^2$ for ethylene group or a propylene group, n for a numeral in the range of 2 to 50 on the average, and $R^3$ for alkyl, phenyl, or naphthyl group having 1 to 20 carbon atoms or alkylphenyl or benzyl group possessing 1 to 3 alkyl groups each of 1 to 10 carbon atoms as a substituent thereof in said general formula I representing said polyalkylene glycol mono(meth)acrylate type monomer (A).

7. The dispersant cf claim 6, wherein $R^2$ in said general formula I stands for an ethylene group.

8. The dispersant of claim 6, wherein $R^3$ in said general formula I stands for methyl group, ethyl group, propyl group, isopropyl group, octyl group, phenyl group, naphthyl group, methylphenyl group, dimethylphenyl group, nonylphenyl group, dinonylphenyl group, octylphenyl group, dioctylphenyl group, or benzyl group.

9. The dispersant of claim 1, wherein $R^4$ stands for hydrogen atom or methyl group, $R^5$ for ethylene group or propylene group, and X for hydrogen atom, sodium atom, potassium atom, ammonium group, or alkanolamine base.

10. The dispersant of claim 9, wherein X in said general formula II stands for monoethanolamine base, diethanolamine base, or triethanolamine base.

11. The dispersant of claim 1, wherein said monomer components are used in proportions such that the amount of said monomer (A) falls in the range of 0.2 to 5 mol %, that of said monomer (B) in the range of 10 to 89.8 mol %, that of said monomer (C) in the range of 10 to 89.8 mol %, and that of said monomer (D) in the range of 0 to 10 mol % (providing that the total amount of said monomers (A), (B), (C), and (D) is 100 mol %).

12. The dispersant of claim 1 wherein said carbonaceous solid is coal.

13. An aqueous carbonaceous solid slurry composition, comprising (a) an aqueous carbonaceous solid slurry composed of a carbonaceous solid and water and (b) 0.01 to 5 parts by weight, based on 100 parts by weight of said carbonaceous solid, of the dispersant according to any of claims 1 to 11.

14. The composition of claim 13, wherein said carbonaceous solid is at least one member selected from the group consisting of coal, coke, and pitch.

15. The composition of claim 13, wherein said carbonaceous solid is coal.

16. The composition of claim 13, wherein said carbonaceous solid content in said composition falls in the range of 40 to 90% by weight.

17. The composition of claim 13 further comprising a dispersion aid, the dispersion aid being used in an amount in the range of 0.01 to 5 parts by weight, based on 100 parts by weight of said carbonaceous solid.

18. The composition of claim 17, wherein said dispersion aid is a polystyrene sulfonic acid or salts thereof or a styrene-styrene sulfonic acid copolymer or salts thereof.

19. The composition of claim 17, wherein said dispersion aid is at least one member selected from the group consisting of naphthalene, sulfonated creosote oil, salts thereof, aliphatic aldehyde addition condensates thereof, aliphatic aldehyde condensates of sulfonate group-containing aminotriazines, and salts thereof.

20. The composition of claim 17, wherein said dispersion aid is a compound essentially containing a tricyclodecane or tricyclodecene skeleton and a sulfonate group in the molecular unit thereof.

21. The composition of claim 17, wherein said dispersion aid is polyether compounds obtained by adding alkylene oxides to formalin condensates of alkylphenols.

22. The composition of claims 13 further comprising a stabilizing agent, said stabilizing agent formed of at least one compound selected from the group consisting of clay minerals, polysaccharides, and alkali metal salts of polyacrylic acid being used in an amount in the range of 0.0001 to 2.0 parts by weight, on 100 parts by weight of said carbonaceous solid.

23. The composition of claim 22, wherein said polysaccharides are sodium salt of carboxymethyl cellulose and hydroxyethyl cellulose.

24. The composition of claim 22, wherein said alkali metal salt of polyacrylic acid is sodium polyacrylate.

25. The composition of claim 13 further comprising a pH adjusting agent, said pH adjusting agent formed of at least one basic substance selected from the group consisting of hydroxides, oxides, and carbonates of alkali metals, hydroxides, oxides, and carbonates of alkaline earth metals, ammonia, and organic amines being used in an amount in the range of 0.01 to 5 parts by weight, based on 100 parts by weight of said carbonaceous solid.

26. The composition of claim 25, wherein said basic substance is sodium hydroixde, potassium hydroxide, calcium hydroxide, magnesium hydroxide, ammonia, monoethanol amine, diethanol amine, or triethanol amine.

* * * * *